US009163446B2

(12) United States Patent
Houser et al.

(10) Patent No.: US 9,163,446 B2
(45) Date of Patent: Oct. 20, 2015

(54) DOOR CONTROL APPARATUS

(75) Inventors: Blue Houser, Edgemoor, SC (US); Tommy McNally, Indian Trail, NC (US); Michael Allen Webb, Cave Creek, AZ (US); Max Stephen Smith, Milan, TN (US); Asa Christiander, Nacka (SE)

(73) Assignee: Yale Security Inc., Monroe, NC (US)

( * ) Notice: Subject to any disclaimer, the term of this patent is extended or adjusted under 35 U.S.C. 154(b) by 626 days.

(21) Appl. No.: 12/725,884

(22) Filed: Mar. 17, 2010

(65) Prior Publication Data

US 2011/0227746 A1 Sep. 22, 2011

(51) Int. Cl.
*G08B 21/00* (2006.01)
*E05F 3/22* (2006.01)
(Continued)

(52) U.S. Cl.
CPC . *E05F 3/22* (2013.01); *E05F 3/222* (2013.01); *E05F 15/40* (2015.01); *E05F 15/70* (2015.01); *E05F 15/73* (2015.01); *E05F 15/74* (2015.01); *E05F 15/79* (2015.01); *E05F 15/00* (2013.01); *E05F 15/43* (2015.01);
(Continued)

(58) Field of Classification Search
CPC ..... E05F 1/00; E05F 1/002; E05F 1/008; E05F 3/22–3/224; E05F 15/00; E05F 15/70; E05F 15/73; E05F 15/74; E05F 15/75; E05F 15/76; E05F 2015/763; E05F 2015/765; E05F 2015/767; E05F 15/79
USPC ..... 340/551, 552, 686.1, 3.1; 49/13, 31, 49/358, 506
See application file for complete search history.

(56) References Cited

U.S. PATENT DOCUMENTS 581,972 A 5/1897 Wright
618,053 A 1/1899 Brown
(Continued)

FOREIGN PATENT DOCUMENTS

CN 1206444 A 1/1999
CN 1358663 A 7/2002
(Continued)

OTHER PUBLICATIONS

Yale Security, Inc., International Patent Application No. PCT/US2008/061441, International Search Report and Written Opinion, Sep. 4, 2008.
(Continued)

*Primary Examiner* — Steven Lim
*Assistant Examiner* — Ryan Sherwin
(74) *Attorney, Agent, or Firm* — Michael G. Johnston; Moore & Van Allen PLLC

(57) ABSTRACT

A door control apparatus and methods for controlling a door motion device for a hinged door and, optionally, illuminating a designated area on the floor. During the time the designated area is illuminated, a person can expect that the door will not close. The door control apparatus may include control circuitry, and a sensor, and optionally a light emitter and/or a sound emitter. The sensor detects a person proximate to the door and signals the control circuitry upon a detection event. The light emitter is also connected to the control circuitry. Upon a detection event, the control circuitry signals the light emitter to produce light and signals the door motion device to hold the door open. The light emitter directs light to form an image on the floor in the designated area. The light emitter may be, for example, a laser generator or a light emitting diode lamp.

42 Claims, 16 Drawing Sheets

(51) Int. Cl.

| | |
|---|---|
| ***E05F 15/70*** | (2015.01) |
| ***E05F 15/40*** | (2015.01) |
| ***E05F 15/73*** | (2015.01) |
| ***E05F 15/74*** | (2015.01) |
| ***E05F 15/79*** | (2015.01) |
| *E05F 15/00* | (2015.01) |
| *E05F 15/43* | (2015.01) |
| *E05F 15/42* | (2015.01) |

(52) U.S. Cl.

CPC ..... *E05F 2015/483* (2015.01); *E05Y 2400/53* (2013.01); *E05Y 2400/59* (2013.01); *E05Y 2400/82* (2013.01); *E05Y 2800/106* (2013.01); *E05Y 2900/132* (2013.01); *Y10T 16/593* (2015.01)

(56) References Cited

U.S. PATENT DOCUMENTS

| | | | | |
|---|---|---|---|---|
| 1,124,941 | A | | 1/1915 | Norton |
| 1,152,339 | A | | 8/1915 | Norton |
| 1,520,765 | A | | 12/1924 | Norton |
| 1,595,722 | A | | 8/1926 | Norton |
| 1,595,723 | A | | 8/1926 | Norton |
| 2,138,521 | A | | 11/1938 | Ellis |
| 2,639,142 | A | | 5/1953 | Morgan et al. |
| 2,758,835 | A | | 8/1956 | Wikkerink |
| 2,843,376 | A | | 7/1958 | Osuch et al. |
| 2,877,639 | A | | 3/1959 | Gust |
| 2,899,701 | A | | 8/1959 | Schroeder |
| 2,924,449 | A | | 2/1960 | Leimer et al. |
| 2,964,779 | A | | 12/1960 | Gohr |
| 2,994,906 | A | | 8/1961 | Check |
| 3,000,043 | A | | 9/1961 | Check |
| 3,003,317 | A | | 10/1961 | Schroeder et al. |
| 3,040,372 | A | | 6/1962 | Ellis |
| 3,044,103 | A | | 7/1962 | Check |
| 3,059,485 | A | | 10/1962 | Bohlman et al. |
| 3,087,720 | A | | 4/1963 | Catlett |
| 3,114,541 | A | | 12/1963 | Coffey |
| 3,135,991 | A | | 6/1964 | Ellis |
| 3,137,888 | A | | 6/1964 | Blom |
| 3,149,366 | A | | 9/1964 | Martin |
| 3,156,001 | A | | 11/1964 | Schmid |
| 3,156,002 | A | | 11/1964 | Schmid |
| 3,161,908 | A | | 12/1964 | Walach |
| 3,174,177 | A | | 3/1965 | Bugge |
| 3,195,879 | A | | 7/1965 | Bond et al. |
| 3,222,709 | A | | 12/1965 | Ellis |
| 3,246,362 | A | | 4/1966 | Jackson |
| 3,255,482 | A | | 6/1966 | Flint |
| 3,259,936 | A | | 7/1966 | Sheridan |
| 3,260,545 | A | | 7/1966 | Check |
| 3,266,080 | A | | 8/1966 | Spencer |
| 3,268,944 | A | | 8/1966 | Sanchez |
| 3,284,950 | A | | 11/1966 | Gute |
| 3,449,789 | A | | 6/1969 | Russell et al. |
| 3,470,653 | A | | 10/1969 | Kalog |
| 3,546,734 | A | | 12/1970 | Pollack et al. |
| 3,560,950 | A | | 2/1971 | Peters |
| 3,593,367 | A | | 7/1971 | Waldo |
| 3,609,390 | A | | 9/1971 | Feldman |
| 3,665,549 | A | | 5/1972 | Quinn |
| 3,675,270 | A | | 7/1972 | Jentsch |
| 3,680,171 | A | | 8/1972 | MacDonald |
| 3,701,180 | A | | 10/1972 | Jentsch et al. |
| 3,708,826 | A | | 1/1973 | Larson |
| 3,719,005 | A | | 3/1973 | Carli |
| 3,724,023 | A | | 4/1973 | Tillmann |
| 3,760,455 | A | | 9/1973 | Berry et al. |
| 3,777,423 | A | | 12/1973 | Coulter et al. |
| 3,781,943 | A | | 1/1974 | Cain |
| 3,785,004 | A | | 1/1974 | Stoffregon |
| 3,838,477 | A | | 10/1974 | Evans et al. |
| 3,852,592 | A | | 12/1974 | Scoville et al. |
| 3,852,846 | A | | 12/1974 | Slaybaugh |
| 3,874,117 | A | | 4/1975 | Boehm |
| 3,886,425 | A | | 5/1975 | Weiss |
| 3,895,849 | A | | 7/1975 | Zehr |
| 3,934,306 | A | | 1/1976 | Farris |
| 3,935,614 | A | | 2/1976 | Pannone et al. |
| 3,955,661 | A | | 5/1976 | Popper et al. |
| 4,034,437 | A | | 7/1977 | Robertson et al. |
| 4,040,143 | A | | 8/1977 | Lasier et al. |
| 4,045,914 | A | | 9/1977 | Catlett |
| 4,050,114 | A | | 9/1977 | Zunkel |
| 4,064,589 | A | | 12/1977 | Bejarano et al. |
| 4,067,084 | A | | 1/1978 | Tillmann |
| 4,069,545 | A | | 1/1978 | Holet et al. |
| 4,115,897 | A | | 9/1978 | Zunkel |
| 4,161,183 | A | | 7/1979 | Berry |
| 4,220,051 | A | | 9/1980 | Catlett |
| 4,222,147 | A | | 9/1980 | Burnett, Jr. |
| 4,267,619 | A | | 5/1981 | Suska |
| 4,285,094 | A | | 8/1981 | Levings, Jr. |
| 4,287,639 | A | | 9/1981 | Denton |
| 4,289,995 | A | | 9/1981 | Sorber et al. |
| 4,330,958 | A | | 5/1982 | Richmond |
| 4,333,270 | A | | 6/1982 | Catlett |
| 4,334,161 | A | | 6/1982 | Carli |
| 4,342,354 | A | | 8/1982 | Leivenzon et al. |
| 4,348,835 | A | | 9/1982 | Jones et al. |
| 4,349,939 | A | | 9/1982 | Tillmann |
| 4,358,870 | A | | 11/1982 | Hong |
| 4,372,005 | A | | 2/1983 | Inesso |
| 4,376,323 | A | | 3/1983 | Tillmann |
| 4,382,311 | A | | 5/1983 | Watts |
| 4,414,703 | A | | 11/1983 | Schnarr |
| 4,419,786 | A | | 12/1983 | Surko, Jr. |
| 4,429,490 | A | | 2/1984 | Zunkel |
| 4,440,428 | A | * | 4/1984 | Jessup et al. ..... 292/251.5 |
| 4,472,910 | A | | 9/1984 | Iha |
| 4,483,043 | A | | 11/1984 | Tillmann |
| 4,486,917 | A | | 12/1984 | Johnston et al. |
| 4,498,033 | A | | 2/1985 | Aihara et al. |
| 4,501,090 | A | | 2/1985 | Yoshida et al. |
| 4,506,407 | A | | 3/1985 | Downey |
| 4,533,905 | A | | 8/1985 | Leivenzon et al. |
| 4,553,656 | A | | 11/1985 | Lense |
| 4,563,625 | A | | 1/1986 | Kornbrekke et al. |
| 4,573,238 | A | | 3/1986 | Phillips |
| 4,590,639 | A | | 5/1986 | Fritsche et al. |
| 4,614,057 | A | | 9/1986 | Sorber |
| 4,621,452 | A | | 11/1986 | Deeg |
| 4,644,693 | A | | 2/1987 | Wang |
| 4,658,468 | A | | 4/1987 | Tillmann et al. |
| 4,658,545 | A | | 4/1987 | Ingham et al. |
| 4,660,250 | A | | 4/1987 | Tillman et al. |
| 4,660,324 | A | | 4/1987 | Nyenbrink |
| 4,663,800 | A | | 5/1987 | Mettenleiter et al. |
| 4,665,378 | A | * | 5/1987 | Heckethorn ..... 340/932.2 |
| 4,665,583 | A | | 5/1987 | Frolov et al. |
| 4,669,147 | A | | 6/1987 | Suchanek |
| 4,669,218 | A | | 6/1987 | Kornbrekke et al. |
| 4,697,383 | A | | 10/1987 | Hagiwara |
| 4,698,937 | A | | 10/1987 | Kornbrekke et al. |
| 4,727,679 | A | | 3/1988 | Kornbrekke et al. |
| 4,750,236 | A | | 6/1988 | Teague, Jr. |
| 4,783,882 | A | | 11/1988 | Frolov |
| 4,785,493 | A | | 11/1988 | Tillmann et al. |
| 4,793,023 | A | * | 12/1988 | Simpson et al. ..... 16/58 |
| 4,815,046 | A | | 3/1989 | Dorr |
| 4,815,163 | A | | 3/1989 | Simmons |
| 4,836,345 | A | | 6/1989 | Anderson |
| 4,847,946 | A | | 7/1989 | Nam et al. |
| 4,848,031 | A | | 7/1989 | Yamagishi et al. |
| 4,852,706 | A | | 8/1989 | Pietrzak et al. |
| 4,872,095 | A | * | 10/1989 | Dubak et al. ..... 362/100 |
| 4,878,265 | A | | 11/1989 | Nesbitt |
| 4,894,883 | A | | 1/1990 | Fleischhauer |
| 4,910,464 | A | | 3/1990 | Trett et al. |
| 4,914,859 | A | | 4/1990 | Gionet et al. |
| 4,920,609 | A | * | 5/1990 | Lin ..... 16/66 |

(56) References Cited

U.S. PATENT DOCUMENTS 4,945,678 A 8/1990 Berner et al.
4,952,080 A 8/1990 Boiucaner et al.
4,966,266 A 10/1990 Yamada et al.
4,972,629 A 11/1990 Meredino et al.
4,973,894 A 11/1990 Johansson
4,995,194 A 2/1991 Schultze et al.
4,999,551 A 3/1991 Yoshida et al.
5,018,304 A 5/1991 Longoria
5,024,124 A 6/1991 Popov et al.
5,040,331 A 8/1991 Merendino et al.
5,048,151 A 9/1991 Orii et al.
5,050,268 A 9/1991 Toledo
5,083,342 A 1/1992 Klinefelter
5,090,089 A 2/1992 Schultze et al.
5,095,654 A 3/1992 Eccleston
5,117,646 A 6/1992 Nose et al.
5,129,091 A 7/1992 Yorimoto et al.
5,142,152 A * 8/1992 Boiucaner ..... 250/341.7
5,187,835 A 2/1993 Lee
5,193,647 A 3/1993 O'Brien, II
5,218,282 A 6/1993 Duhame
5,219,275 A 6/1993 Ribaudo
5,221,239 A 6/1993 Catlett
5,222,327 A 6/1993 Fellows et al.
5,227,631 A * 7/1993 Hunter et al. ..... 250/352
5,230,074 A 7/1993 Canova, Jr. et al.
5,243,735 A 9/1993 O'Brien, II
5,251,400 A 10/1993 Schultze
5,259,090 A 11/1993 Fayngersh
5,265,306 A 11/1993 Yu
5,272,787 A 12/1993 Salena et al.
5,278,480 A 1/1994 Murray
5,291,630 A 3/1994 Brown
5,337,448 A 8/1994 Brown
5,343,593 A 9/1994 Fayngersh
5,375,374 A 12/1994 Rohroff, Sr.
D355,580 S 2/1995 Salena et al.
5,386,614 A 2/1995 Fayngersh
5,386,885 A 2/1995 Bunzl et al.
5,417,013 A 5/1995 Tillmann
5,428,278 A 6/1995 Bollengier et al.
5,468,042 A 11/1995 Heinrichs et al.
5,502,874 A 4/1996 Lucas
5,507,120 A 4/1996 Current
5,511,284 A 4/1996 Current
5,513,467 A 5/1996 Current et al.
5,589,747 A 12/1996 Utke
5,594,316 A 1/1997 Hayashida
5,630,248 A 5/1997 Luca
5,634,296 A 6/1997 Hebda
5,634,298 A 6/1997 Slopack
5,636,477 A 6/1997 Hulse et al.
5,651,216 A 7/1997 Tillmann
5,666,692 A 9/1997 Toledo
5,687,507 A 11/1997 Beran
5,698,073 A 12/1997 Vincenzi
5,706,551 A 1/1998 Jeynes et al.
5,709,009 A 1/1998 Lasson et al.
5,752,344 A 5/1998 Richmond
5,770,934 A 6/1998 Theile
5,802,670 A 9/1998 Bienek
5,808,654 A 9/1998 Loos
5,828,302 A 10/1998 Tsutsumi et al.
5,829,097 A 11/1998 Toledo
5,829,508 A 11/1998 DeBower et al.
5,832,561 A 11/1998 Bienek
5,832,562 A 11/1998 Luca
5,850,671 A 12/1998 Kaser
5,851,049 A 12/1998 Squire et al.
5,851,050 A 12/1998 Squire et al.
5,878,530 A 3/1999 Eccleston et al.
5,881,497 A 3/1999 Borgardt
5,901,412 A 5/1999 Jentsch
5,903,217 A * 5/1999 Stanczak et al. ..... 340/554
5,910,075 A 6/1999 Arnell et al.
5,913,763 A 6/1999 Beran et al.
5,930,954 A 8/1999 Hebda
5,956,249 A 9/1999 Beran et al.
5,957,108 A 9/1999 Kato
5,963,000 A 10/1999 Tsutsumi et al.
5,987,818 A 11/1999 Dabideen
6,002,217 A 12/1999 Stevens et al.
6,006,475 A 12/1999 Schwantes et al.
6,067,753 A 5/2000 Hebda
6,108,975 A 8/2000 Bailey
6,115,965 A 9/2000 Jennings
6,118,243 A 9/2000 Reed et al.
6,135,514 A 10/2000 Kowalewski et al.
6,167,589 B1 1/2001 Luedtke
6,185,773 B1 2/2001 Goedde
6,209,695 B1 4/2001 Braford
6,218,962 B1 * 4/2001 Fiene ..... 340/932.2
6,223,469 B1 5/2001 Moll
6,225,904 B1 * 5/2001 Jaffe et al. ..... 340/545.6
6,260,236 B1 7/2001 Toledo
6,282,750 B1 9/2001 Bishop et al.
6,316,892 B1 11/2001 Valencia
6,318,196 B1 11/2001 Chang
6,326,754 B1 * 12/2001 Mullet et al. ..... 318/480
6,336,294 B1 1/2002 Kowalczyk et al.
6,343,437 B1 2/2002 Hoffmann et al.
6,347,485 B1 2/2002 Hebda
6,357,805 B1 3/2002 Hebda
6,384,414 B1 5/2002 Fisher et al.
6,397,430 B1 6/2002 Brown et al.
6,397,431 B1 6/2002 Alonso
6,412,224 B1 7/2002 Feucht et al.
6,430,871 B1 8/2002 Hebda
6,434,788 B1 8/2002 Schulte
6,442,795 B1 9/2002 Chen
6,469,464 B1 10/2002 McCall
6,481,160 B1 11/2002 Kowalczyk
6,484,784 B1 11/2002 Weik, III et al.
6,493,904 B1 12/2002 Chiang
6,497,004 B1 * 12/2002 Armstrong ..... 16/66
6,530,178 B1 3/2003 Kowalczyk et al.
6,553,717 B2 4/2003 St. John et al.
6,563,431 B1 5/2003 Miller, Jr.
6,588,153 B1 7/2003 Kowalczyk
6,618,899 B1 9/2003 Ginzel et al.
6,633,094 B1 10/2003 Andou
6,634,140 B1 10/2003 Sellman
6,640,494 B2 11/2003 Hormann
6,678,999 B2 1/2004 Zeungguang et al.
6,751,909 B2 6/2004 Ranaudo
6,782,660 B2 8/2004 Takada et al.
6,786,006 B2 9/2004 Kowalczyk et al.
6,883,275 B2 4/2005 Hellinga et al.
6,886,217 B2 5/2005 Foster
6,891,479 B1 5/2005 Eccleston
6,904,643 B2 * 6/2005 Duffy ..... 16/83
6,959,949 B2 11/2005 Rockenbach
7,064,666 B2 * 6/2006 Sasaki et al. ..... 340/545.3
7,068,179 B2 6/2006 Snell et al.
7,124,469 B2 10/2006 Tsekhanovsky et al.
7,138,912 B2 11/2006 Fitzgibbon et al.
7,170,248 B2 1/2007 Tsui et al.
7,234,201 B2 6/2007 Brown et al.
7,270,029 B1 9/2007 Papanikolaou et al.
7,296,380 B2 11/2007 Backman
7,316,096 B2 1/2008 Houser et al.
7,324,894 B2 1/2008 Urman et al.
7,418,800 B1 9/2008 Sellman
7,490,841 B2 2/2009 Castello et al.
7,495,556 B2 2/2009 Eubelen et al.
7,571,515 B2 8/2009 Fischbach et al.
7,690,802 B2 * 4/2010 Higley et al. ..... 362/20
7,762,022 B2 * 7/2010 Stadler et al. ..... 49/506
8,225,458 B1 7/2012 Hoffberg
2001/0007163 A1 7/2001 Alonso
2001/0015033 A1 8/2001 Minami
2002/0066229 A1 * 6/2002 Rubio ..... 49/139
2002/0092126 A1 7/2002 Chen
2002/0092237 A1 7/2002 Hebda

(56) References Cited

U.S. PATENT DOCUMENTS

| | | | | |
|---|---|---|---|---|
| 2002/0133904 | A1 | 9/2002 | Donovan et al. | |
| 2003/0097793 | A1 | 5/2003 | Kowalczyk et al. | |
| 2003/0167693 | A1* | 9/2003 | Mainini | 49/28 |
| 2003/0204935 | A1 | 11/2003 | Kim | |
| 2003/0213092 | A1 | 11/2003 | Fischbach | |
| 2004/0034964 | A1 | 2/2004 | Loggen et al. | |
| 2004/0035057 | A1 | 2/2004 | Backman | |
| 2004/0251868 | A1 | 12/2004 | Sato et al. | |
| 2005/0073425 | A1 | 4/2005 | Snell et al. | |
| 2005/0091928 | A1 | 5/2005 | Okulov et al. | |
| 2005/0154602 | A1 | 7/2005 | Hertz | |
| 2006/0021189 | A1 | 2/2006 | Johnson | |
| 2006/0086468 | A1 | 4/2006 | Altimore | |
| 2006/0090400 | A1 | 5/2006 | Los et al. | |
| 2006/0191204 | A1 | 8/2006 | Herwig et al. | |
| 2006/0197481 | A1 | 9/2006 | Hotto et al. | |
| 2006/0242908 | A1 | 11/2006 | McKinney | |
| 2006/0244271 | A1 | 11/2006 | Hass | |
| 2008/0115543 | A1 | 5/2008 | Lanigan et al. | |
| 2009/0034208 | A1 | 2/2009 | Suzuki | |
| 2009/0260289 | A1* | 10/2009 | Carpenter et al. | 49/26 |
| 2009/0265992 | A1 | 10/2009 | Hass et al. | |
| 2009/0300988 | A1 | 12/2009 | Bem | |

FOREIGN PATENT DOCUMENTS

| | | | |
|---|---|---|---|
| CN | 1448608 | A | 10/2003 |
| CN | 1804356 | A | 7/2006 |
| DE | 43 39 272 | A1 | 5/1994 |
| DE | 20218327 | | 5/2004 |
| DE | 10 2005 001 317 | A1 | 7/2006 |
| DE | 10 2007 030 084 | A1 | 1/2009 |
| EP | 0144882 | B1 | 6/1985 |
| EP | 0292743 | B1 | 11/1988 |
| EP | 0217228 | B1 | 12/1989 |
| EP | 1 340 877 | A2 | 9/2003 |
| EP | 1 683 939 | A1 | 7/2006 |
| EP | 2 009 210 | A2 | 12/2008 |
| EP | 2 009 215 | A1 | 12/2008 |
| EP | 2 075 397 | A2 | 7/2009 |
| EP | 1 375 808 | B1 | 10/2010 |
| EP | 2 270 303 | A2 | 1/2011 |
| FR | 2508530 | | 12/1982 |
| GB | 2244092 | A | 11/1991 |
| GB | 2278882 | A | 12/1994 |
| GB | 2 438 422 | A | 11/2007 |
| JP | 1296399 | | 11/1989 |
| JP | 4131488 | B2 | 5/1992 |
| JP | 6033994 | | 2/1994 |
| JP | 9209652 | | 8/1997 |
| JP | 11324483 | | 11/1999 |
| JP | 2000213234 | | 8/2000 |
| JP | 2001090431 | | 4/2001 |
| JP | 2002174073 | | 6/2002 |
| JP | 2004244882 | | 9/2004 |
| JP | 2009270278 | | 11/2009 |
| WO | 99/39069 | A1 | 8/1999 |
| WO | 00/08286 | A1 | 2/2000 |
| WO | WO 2007135371 | A1 | 11/2007 |

OTHER PUBLICATIONS

Yale Security, Inc., International Patent Application No. PCT/US2008/061441, International Preliminary Report on Patentability, Oct. 27, 2009.

Yale Security, Inc., International Patent Application No. PCT/US2005/023398, International Search Report and Written Opinion, Aug. 20, 2007.

Yale Security, Inc., International Patent Application No. PCT/US2005/023398, International Preliminary Report on Patentability, Sep. 11, 2007.

Larco, Presence-Sensing Door Control Package SW02-36 through SW02-48 for Single Doors with Mats on Both Sides and Two-Way Traffic, www.larcomfg.com/Portals/Larco/Documents/Automatic%20Door%20Market/Specifications/Single%20Swing/SW02specs.pdf, 6 pages, visited Oct. 7, 2009.

Tormax Technologies, Inc., TDA Swing Door Systems, products.construction.com/Manufacturer/Tormax-Technologies-Inc-NST20185/products/TDA-Swing-Door-Systems-NST3960-P, 3 pages, visited Oct. 7, 2009.

Nabco,Ltd., Nabco Entrances Swing Doors, www.floridadoorcontrol.com/nabco__swing__doors.htm, 3 pages, visited Oct. 7, 2009.

The Stanley Works, Swing Door Systems, www.stanleyaccesstechnologies.com/products/lit/Swing%20Door%20Series%20AT9706.pdf, 4 pages, dated Jun. 2002, visited Oct. 7, 2009.

Horton Automatics, Automatic Swinging Door, www.hortondoors/docs/m310.pdf, 8 pages, dated Oct. 2000, visited Oct. 7, 2009.

Elder Store, Motion Sensor for Automatic Swing Door Opener, www.elderstore.com/motion-sensor-for-automatic-swing-door-opener.aspx, 1 page, visited Oct. 7, 2009.

Product Review, Home & Garden, Garage Door Operators, Boss BS1, www.productreview.com.au, 1 page, visited Jun. 17, 2009.

Christy Commercial Hardware, Jackson Closers, www.christyhardware.com, 1 page, visited Jun. 17, 2009.

LCN Closers, catalog, dated Mar. 2004, pp. 37-40.

LCN Closers, catalog, dated 2004, downloaded from <http://lcn.ingersollrand.com/fdfs/4410HSA__PTS__LST.pdf> on May 9, 2013, pp. 17-18.

European Patent Office, PCT International Search Report and Written Opinion of the International Searching Authority for International Application No. PCT/US2011/028077 date of completion Apr. 14, 2011.

European Patent Office, PCT Written Opinion of the International Searching Authority for International Application PCT/US2011/028077 dated Aug. 13, 2012.

European Patent Office, PCT International Preliminary Report on Patentabilityand Written Opinion of the International Searching Authority for International Application No. PCT/US2011/028077 date of completion Nov. 5, 2012.

Australian Patent Office, Australian Patent Application No. 2011227577 Office Action dated Jun. 20, 2014, 4 pages.

Chinese Patent Office, Chinese Patent Application No. 201180024692.8 dated Jun. 26, 2014, with English translation, 39 pages.

Yale Security Inc., European Application No. 11709595.0, Office Action, Feb. 4, 2015.

Yale Security Inc., Israeli Application No. 221998, Office Action, Feb. 18, 2015.

Yale Security Inc., Chinese Application No. 201180024692.8, Second Office Action, Apr. 3, 2015.

* cited by examiner

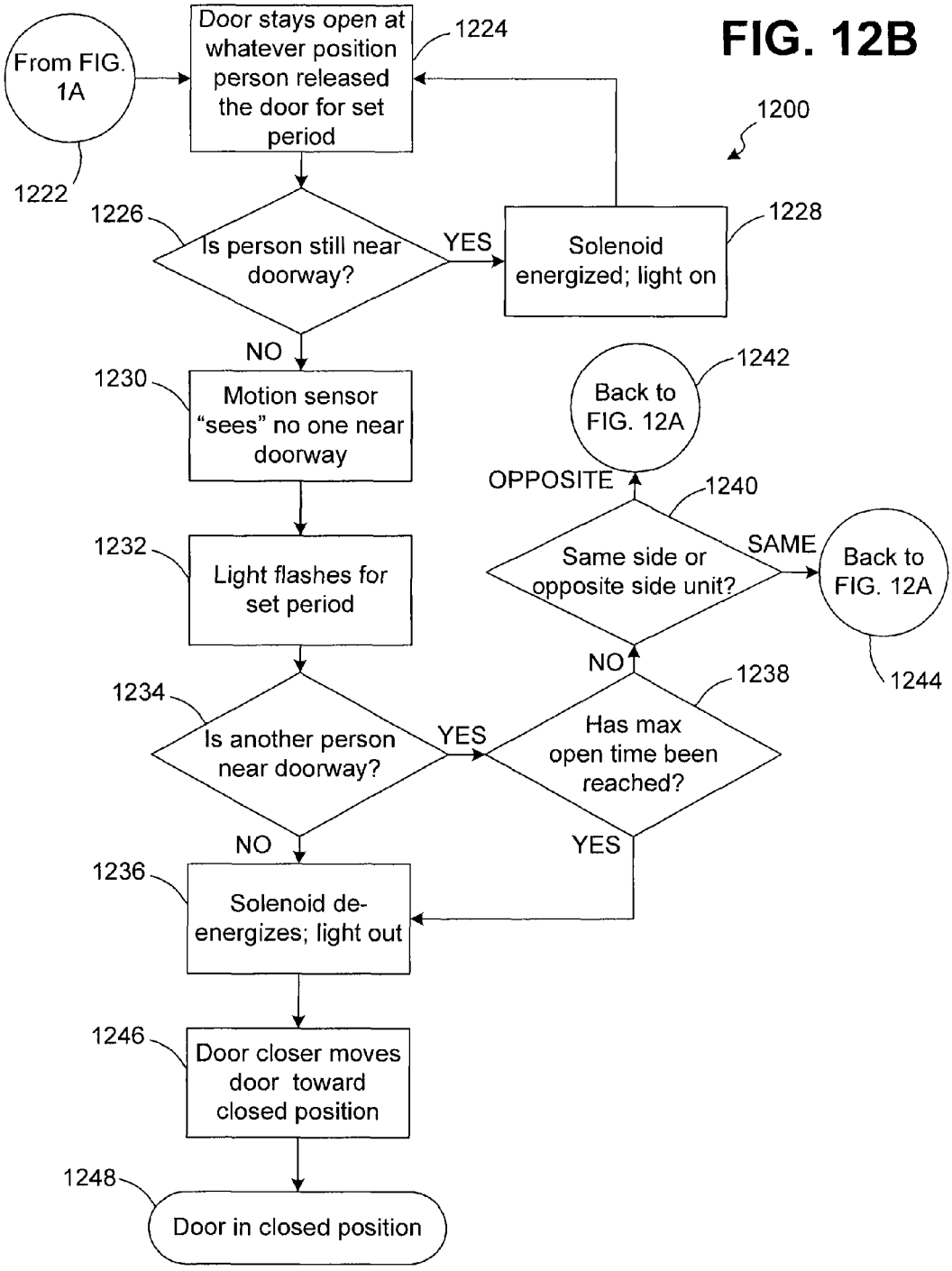
FIG. 12B
1200
From FIG. 1A
1222
Door stays open at whatever position person released the door for set period
1224
1226
Is person still near doorway?
YES
Solenoid energized; light on
1228
NO
1230
Motion sensor "sees" no one near doorway
1232
Light flashes for set period
1234
Is another person near doorway?
YES
NO
1236
Solenoid de-energizes; light out
1246
Door closer moves door toward closed position
1248
Door in closed position
1238
Has max open time been reached?
NO
YES
1240
Same side or opposite side unit?
OPPOSITE
SAME
1242
Back to FIG. 12A
Back to FIG. 12A
1244

DOOR CONTROL APPARATUS

BACKGROUND

Electromechanical door holders and automatic door operators are two types of devices that provide automatic functions with respect to doors. Electromechanical door holders generally include a door closer and apparatus that arrests the operation of the door closer. Electromechanical door holders may be attached to the structure adjacent to a door, such as a door frame or wall, and a pivotable arm extends from the door operator to the door, or alternatively, the electromechanical door holder may be mounted to the door, and the pivotable arm may extend to the adjacent structure. The door closer is intended to provide a smooth, controlled closing action to the door after the door has been opened and released.

Many conventional door closers are mechanically actuated and have a piston and a plurality of springs and valved ports. The piston moves through a reservoir filled with a hydraulic fluid, such as oil. The piston is coupled to the door closer's arm through a rack and pinion such that, as the door is opened, the piston is moved in one direction and, as the door is closed, the piston is moved in the opposite direction. As the piston moves, it displaces hydraulic fluid, which may be forced through various ports. The force exerted by the door closer depends on loading of a compression spring and the speed of the action depends on the open or closed status of the ports. The ports are adjustable (open or closed) via needle valves that control flow of hydraulic fluid between chambers, and the compression spring setting may or may not be adjustable based on the construction of the door closer. The valves may be operated with solenoids connected to a power supply. Energizing a solenoid may close a valve, prevent flow of hydraulic fluid, and thereby provide a hold-open feature to the door closer, making an electromechanical door holder.

With respect to door operators, the purpose of a door operator is to open and close a door. In general, a door operator may be mounted similarly to an electromechanical door holder. Automatic, hinged doors with door operators generally include motorized door openers and door closers that may be powered or spring assisted. The door may open manually or automatically upon actuation of a switch often placed on a wall proximate to the door. When automatic operation is initiated, the door commonly proceeds through a sequence that includes starting the motor, the motor driving the door to an open position, the door being held open for a set period, and then the motor turning off or reversing direction to allow the door closer to close the door.

A variety of automatic door operators is known. A typical door operator includes an electric motor and a linkage assembly for operatively coupling the drive shaft of the motor to a door so that the door will be opened and closed when the drive shaft rotates. Activation of the door operator is initiated by means of an electric signal generated in a variety of ways such as, for example, a pressure switch, an ultrasonic or photoelectric presence sensor, motion sensors, radio transmitters, wall switches, and the like. The door may then be closed under power or with a door closer, as used in an electromechanical door holder.

The automatic, predetermined timing of closing of an automatic door with either a door operator or a door holder creates the opportunity for the door to close on a person who or an object that does not or cannot pass through the doorway in sufficient time to avoid the closing door.

SUMMARY OF THE INVENTION

In accordance with one embodiment described herein, a door control apparatus may be in electrical communication with an electromechanical door holder for operative connection to a hinged door, the hinged door being above a floor and pivotally movable between a closed position and a fully open position. The hinged door may be mounted to a structure surrounding the door in the closed position, with the structure including a door frame and a wall. The door control apparatus includes control circuitry and a sensor. The sensor is adapted to detect a person, object, or both in a first designated area proximate to the door. The sensor is connected to the control circuitry and is operable to signal the control circuitry upon a detection event. Upon a detection event the control circuitry is operable to signal the electromechanical door holder to hold the door open. The door control apparatus may further include a light emitter that is also connected to the control circuitry, which is operable to signal the light emitter to produce light.

The light emitter may further be adapted to direct light to form an image on the floor in a second designated area. When the second designated area is illuminated, the door is not in the process of closing. The control circuitry may also be operable to signal the light emitter to change the light status a first predetermined time after the sensor detects nothing in the first designated area, and may be adapted to signal the electromechanical door holder to initiate door closing after a second predetermined time, with the first and second predetermined times being measured by a timer in the control circuitry. The light emitter may be, for example, a laser generator or a light emitting diode lamp.

In accordance with another embodiment described herein, a door motion controller is provided for applying force to a hinged door, the hinged door being above a floor and pivotally movable between a closed position and a fully open position. The hinged door is mounted to a structure surrounding the door in the closed position, with the structure including a door frame and a wall. The door motion controller includes an electromechanical door holder adapted to operatively connect to the hinged door, and a door control apparatus. The door control apparatus is adapted to be in electrical communication with the electromechanical door holder and includes control circuitry and a sensor. The sensor is adapted to detect a person, object, or both in a first designated area proximate to the door. The sensor is connected to the control circuitry, and is operable to signal the control circuitry upon a detection event. Upon a detection event the control circuitry is operable to signal the electromechanical door holder to hold the door open. The door control apparatus may further include a light emitter that is also connected to the control circuitry, which is operable to signal the light emitter to produce light.

In accordance with another embodiment described herein, a door assembly that may be positioned above a floor proximate to a structure including a door frame and wall is provided. The door assembly includes a hinged door, a door motion device, and door control apparatus. The hinged door is pivotally movable between a closed position and a fully open position, and mounted to the structure surrounding the door in the closed position. The door motion device is adapted to operatively connect to the hinged door. The door control apparatus is adapted to be in electrical communication with the door motion device and includes control circuitry, a sensor, and a light emitter. The sensor is adapted to detect a person, object, or both in a first designated area proximate to the door. The sensor is connected to the control circuitry, and is operable to signal the control circuitry upon a detection event. The light emitter is also connected to the control circuitry. Upon a detection event the control circuitry is operable to signal the light emitter to produce light and is operable to signal the door motion device to hold the door open.

In accordance with another embodiment described herein, a method of operating a hinged door using an electromechanical door holder is provided. The hinged door being may be above a floor and pivotally movable between a closed position and a fully open position, and may be mounted to a structure surrounding the door in the closed position, with the structure including a door frame and a wall. The method may include a sensor detecting a person, object, the door moving to an open position, or a combination thereof in a first designated area, the sensor signaling control circuitry. A timer in the control circuitry is started, and the control circuitry signals the electromechanical door holder and the electromechanical door holder maintains the door in an open position. The sensor may continue to detect a person or object in the first designated area and signaling the control circuitry to keep the door open, and when the sensor detects nothing in the first designated area, signaling the control circuitry may be ceased. The control circuitry may signal a light emitter to produce light. The light emitter may direct light to form an image on a second designated area on the floor. The control circuitry may signal the light emitter to flash the light for a set period. If the sensor again detects a person or object in the first designated area, the sensor may signal the control circuitry, and the control circuitry may signal the electromechanical door holder to keep the door open and signaling the light emitter to produce constant light. If the sensor detects nothing in the first designated area by the end of the set period, the control circuitry may signal the light emitter to turn off the light and signal the electromechanical door holder to initiate closing of the door.

BRIEF DESCRIPTION OF THE DRAWINGS

For a more complete understanding of embodiments of a door control apparatus and associated methods, reference should now be had to the embodiments shown in the accompanying drawings and described below. In the drawings:

FIGS. 12A-12B are a flow chart of the operation of a door control apparatus embodiment used in conjunction with an electromechanical door holder.

DETAILED DESCRIPTION

Certain terminology is used herein for convenience only and is not to be taken as a limitation on the embodiments described. For example, words such as "top", "bottom", "upper," "lower," "left," "right," "horizontal," "vertical," "upward," and "downward" merely describe the configuration shown in the figures. Indeed, the referenced components may be oriented in any direction and the terminology, therefore, should be understood as encompassing such variations unless specified otherwise.

As used herein, the term "open position" for a door means a door position other than a closed position, including any position between the closed position and a predetermined fully open position as limited only by structure around the door frame, which can be up to 180° from the closed position.

Figure 1:
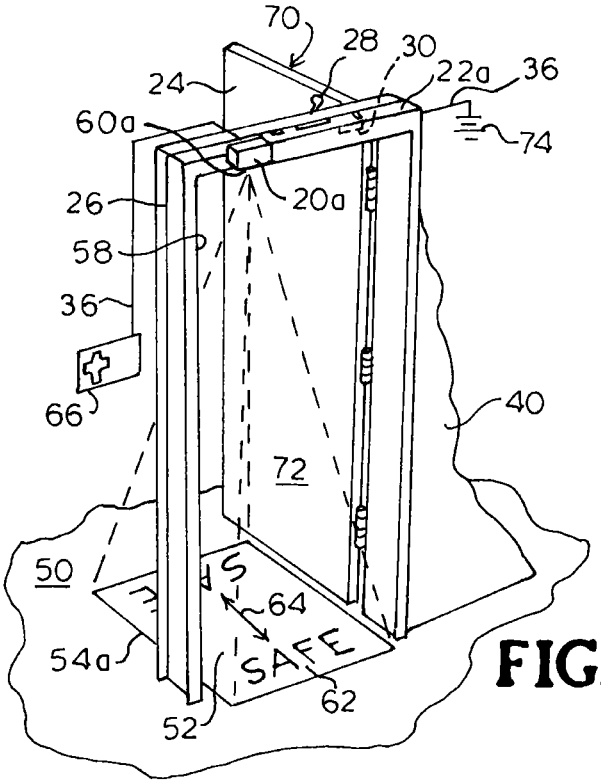
FIGS. 1 and 2 are perspective views of two embodiments of installed door control apparatus.
Figure 2:
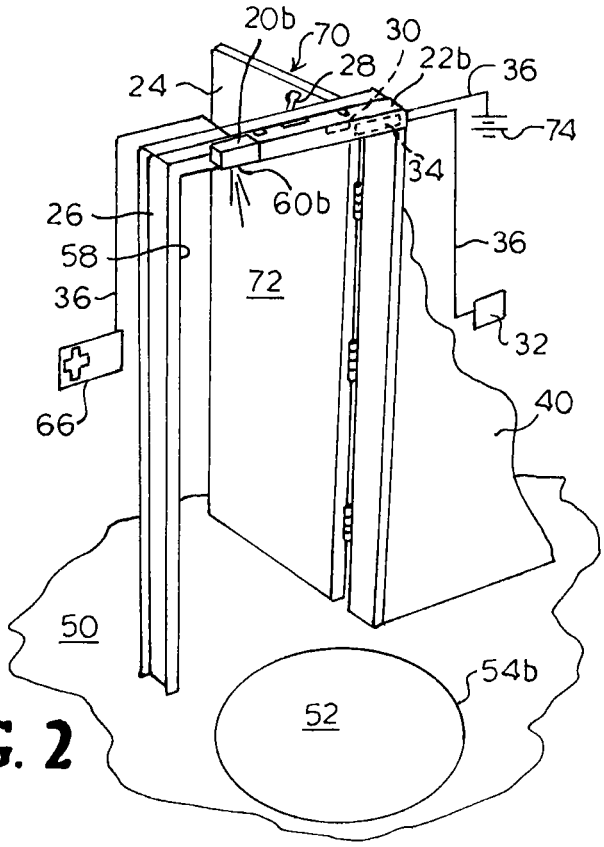

Referring now to the drawings, wherein like reference numerals designate corresponding or similar elements throughout the several views, two embodiments of a door control apparatus are shown in FIGS. 1 and 2 respectively, and are generally designated at 20*a* and 20*b*. The door control apparatus 20*a*, 20*b* is mounted adjacent to door motion device 22*a*, 22*b*, and both are mounted adjacent to a door 24 in a door frame 26 for movement of the door 24 relative to the frame 26 between a closed position and an open position. The door motion device 22*a*, 22*b* is operatively connected to the door 24 with an arm operator arm assembly 28. The door motion device may be an electromechanical door holder 22*a* with a door closer including at least one spring, valve, and solenoid 30 as shown in FIG. 1, or an automatic door operator 22*b*, connected to an opening switch 32 and a motor 34 with wiring 36, and optionally with a door closer including at least one spring, valve, and solenoid 30. The door 24 may be of a conventional type and is pivotally mounted to the frame 26 for movement from the closed position, as shown in FIG. 1, to an open position for opening and closing an opening through a building wall 40 to allow a user to travel from one side of the wall 40 to the other side of the wall 40. The wall 40 may be of any material, for example, drywall, paneling, brick, block, glass (block or window), and so forth.

In both embodiments of door control apparatus 20*a*, 20*b*, a light in the visible spectrum may be projected onto the ground or floor 50 that may indicate an illuminated area 52 that communicates that the door 24 is not about to close. The illuminated area 52 may correspond to a "safe zone" in which a person or object may be located to prevent the door from closing when the person or object is detected by a sensor in the door control apparatus 20*a*, 20*b*. Alternatively, the position of the light may not necessarily correspond to the range of the sensor. The visible light may be from various types of light emitters, for example, laser light 54*a* from a laser generator 60*a* as in the door control apparatus 20*a* of FIG. 1, or light emitting diode (LED) light 54*b* from an LED lamp 60*b* as in the door control apparatus 20*b* of FIG. 2. The sensor will cause the door 24 to be held open when an area near the doorway 58 is occupied, with the range and orientation of the sensor provided as determined by one of ordinary skill in the art. A line of laser light 54*a* may outline the illuminated area 52 or may take the form of lines, words, or another pattern making an image on the floor, while an LED will light a spot 54*b* on the floor to indicate the illuminated area 52. While the embodiments of FIGS. 1 and 2 as described reflect the areas detected by the sensor and illuminated by the light emitter as generally corresponding to one another, it is contemplated that the light may be directed to one area while the sensor is set to detect movement in another direction, or a larger, overlapping area.

As shown, the shape of the laser light line 54*a* on the floor 50 is a rectangle, but the light may be an oval or any possible shape as selected by one of ordinary skill in the art, and may include words 62 or other indicia, such as arrows 64. Green light may be used in one embodiment to signal that the door 24 is not about to close; flashing green or yellow light could signal that the door 24 is going to close. An LED may light a spot 54*b* of colored light, such as a soft green glow, on the floor 50 to designate the illuminated area 52, shown as an oval in FIG. 2. In addition, a selectively lighted display 66 may be provided on one or both sides of the door 24 to alert people that the door is about to open or that the doorway 58 is indeed safe to enter without an expectation of the door closing. The illuminated area 52 may be lit green, for example, when it is safe to enter the doorway 58, and may flash when the door 24 is about to close. The display 66 may also flash, for example, on the "pull side" 70 of the door, towards which the door will open, when someone from the opposite "push side" 72 is going to open the door, and display 66 may flash in a green or yellow light when the door 24 is about to open. The door motion device 22*a*, 22*b*, door control apparatus 20*a*, 20*b*, switch 32, and display 66 are connected with wiring 36 to an electrical power source 74.

Figure 3:
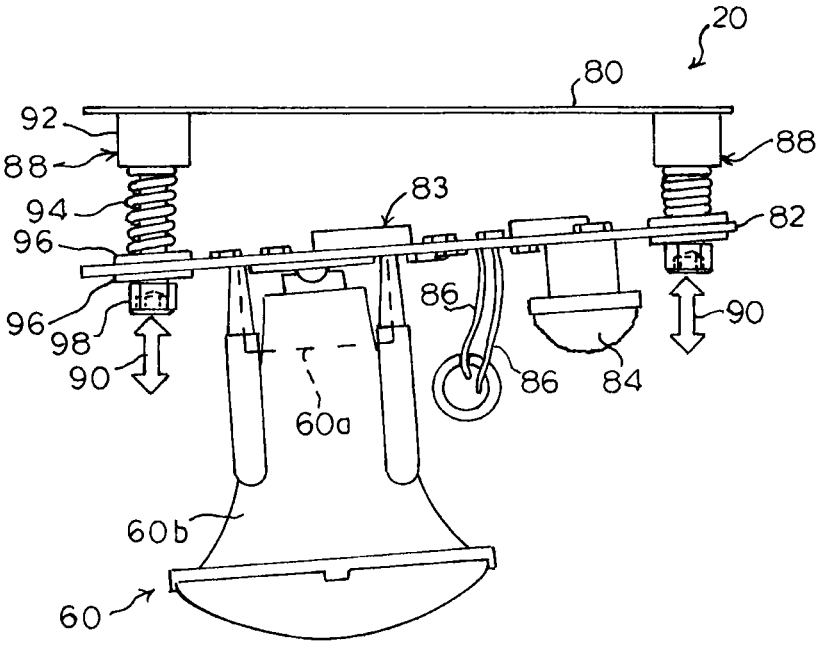
FIG. 3 is an elevation view of an embodiment of a door control apparatus as shown in FIG. 2.
Figure 4:
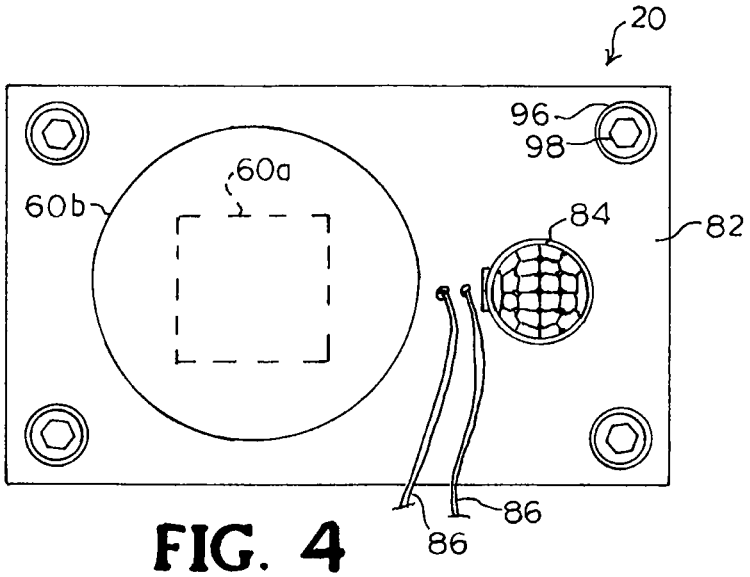
FIG. 4 is a bottom plan view of the embodiment of the door control apparatus as shown in FIG. 3.

An embodiment of the door control apparatus 20 is shown in FIGS. 3 and 4. The door control apparatus 20 includes a housing 80, which is shown only in part, a mounting board, which in this embodiment includes electronic circuitry and is a printed circuit board (PCB) 82, a light emitter shown as an LED lamp 60*b*, or alternatively laser generator 60*a*, a sensor 84, and electrical wiring 86 to connect the PCB 82 to the door motion device 22 and the electrical power source 74. Laser generator 60*a* is shown schematically, and may also represent any type of light emitter. The light emitter 60 and sensor 84 are mounted and electrically connected to the PCB 82, which may alternatively be any other type of mounting member. Control circuitry 83 may be included on the PCB or otherwise associated with any mounting member. The PCB 82 may be substantially a rectangle shape and is adjustably mounted to the housing 80 with hardware 88 in each corner of the PCB 82 that allows directing of the LED 60*b* and sensor 84 based on angling of the PCB 82. In the door control apparatus 20*a*, 20*b* shown, the angling of the PCB 82 is performed through the vertical movement 90 available at each corner. The door control apparatus 20*a*, 20*b* may also be configured to permit angling of the light emitter 60*a*, 60*b* and sensor 84 in different directions, for example, on different sides of the doorway 42. Optionally, the light emitter 60*a*, 60*b* may be omitted. The light emitter 60*a*, 60*b* and sensor 84 may also be mounted separately, such as in different housings on the same or opposite sides of the doorway 58.

The light emitter may be any LED lamp 60*b* or other type of light emitter that projects a discernable lighted area on the floor as selected by one of ordinary skill in the art, such as a high intensity discharge lamp (spot light) or a laser light 60*a*. Appropriate light emitters include for LED, Light Engines, from Lighting Sciences Group Corp. of Satellite Beach, Fla., the Atlas I series, 216 lumens, green color, and for lasers, a laser generator as selected by one of ordinary skill in the art. The sensor 84 may be a sensor that detects the presence or motion of a person or object in an area at least as large as, or larger than, the illuminated area 52. Sensors appropriate for use with door control apparatus 20*a*, 20*b* include passive infrared type motion sensors such as those made by Panasonic Electric Works Co., Ltd., MP Motion Sensor, and in particular the 10 m detection type, low current consumption, with a detection range of 110 degrees horizontal and 93 degrees vertical. This sensor detects changes in infrared radiation that occur when there is movement by a person or object that has a different temperature than the environment. Another sensor appropriate for use with the door control apparatus 20*a*, 20*b*, which may be mounted separately from the housing 80, is a microwave sensor such as that manufactured by BEA Inc. of Pittsburgh, Pa., Eagle Motion Sensor, which operates at 24.125 GHz with a planar antenna with motion detection based on the Doppler effect. Other types of sensors, such as ultrasonic or photoelectric may be selected as known by one of ordinary skill in the art.

As an alternative embodiment, the lamp designated as 60, 60*a*, or 60*b* may be instead a sound emitter, such as a speaker, other sound transducer, or producer of sound as known by one of ordinary skill in the art. The sound emitter may be mounted separately from the rest of the apparatus, or may be located as shown. Yet further, the part 60, 60*a*, or 60*b* may designate both a light emitter and a sound emitter. The sound emitter may be selectively signaled to alarm when the door is opening, is about to close, or is closing.

The control circuitry 83 uses a constant current source which supplies power needed to the light emitter. Overall product functionality may be controlled by an eight bit microcontroller. User adjustments for delay time, number of warning flashes and, where an LED is used, LED light intensity, may be provided. Cold contact relay switches may be controlled by the microcontroller to switch a solenoid and an external alarm. Control circuitry 83 associated with the PCB 82, other mounting member, or the door control apparatus 20 overall, may further include features such as an embedded processor, memory, a digital signal processor, a motion sensor chip, and a laser control chip, as selected by one of ordinary skill in the art.

The door motion device 22 may be any automatic door operator or electromechanical door holder, such as the 6900 Series Powermatic® automatic door operator or 7200 Series Electromechanical Closer-Holder models from Norton Door Controls of Monroe, N.C., an ASSA ABLOY Group company.

Hardware 88 in each corner to fasten the PCB 82 to the housing 80 and to provide adjustability may include a blind self-cinching fastener 92 such as PEM® brand manufactured by PennEngineering of Danboro, Pa., a spring 94, two washers 96, and a hex socket machine screw 98.

FIGS. 5-11 show various configurations of a door 24, door frame 26, door motion device 22, and door control apparatus 20, which may include a laser generator 60*a* or an LED lamp 60*b* or other light emitter (not shown). The rectangle on the floor 50 represents laser light 54*a* designating the illuminated area 52, while the oval on the floor represents LED light 54*b*. The illuminated area 52 is lit substantially on the pull side 70 of the door, and detection by the sensor 84 also includes the area on the pull side 70. Two alternative, exemplary, schematic, sensing orientations and ranges 100 are shown in each figure, one of each of which generally corresponds with the illuminated area 52 and the other does not.

Figure 5:
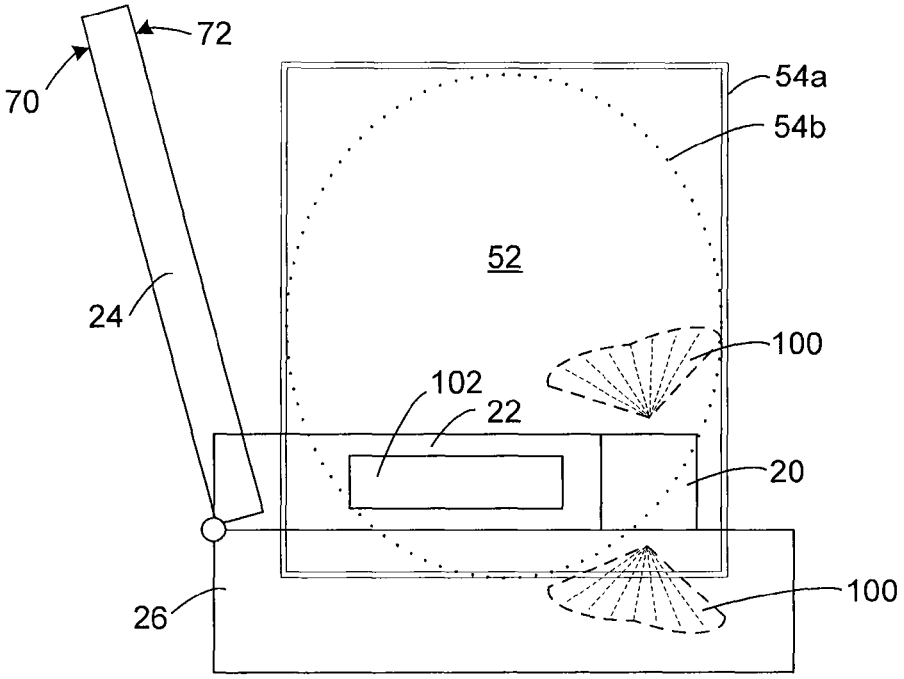
FIGS. 5-11 are plan views of various embodiments of configurations of installed door control apparatus.
Figure 6:
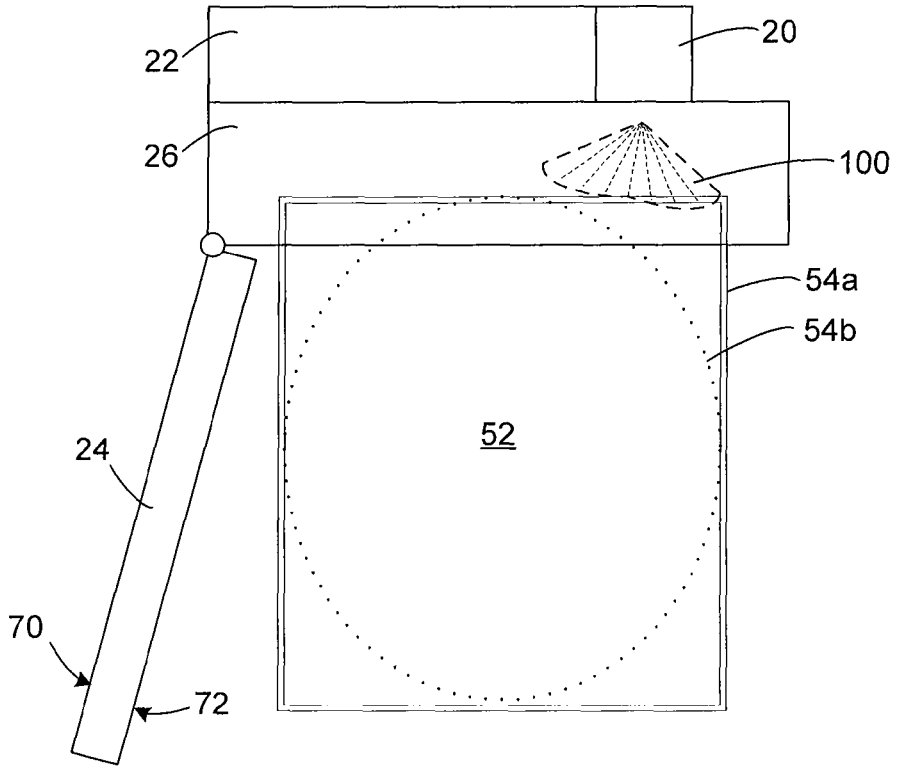
Figure 7:
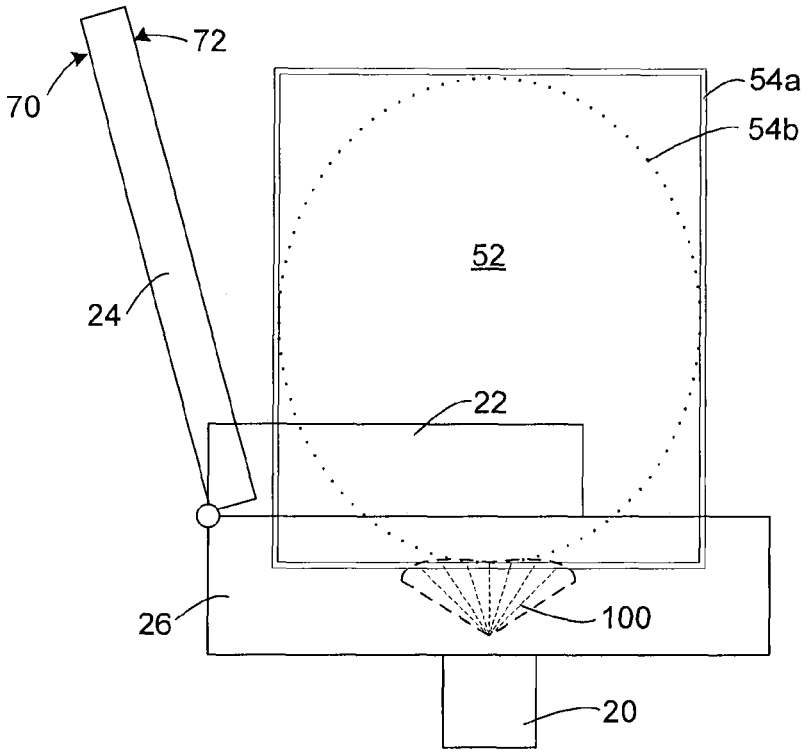
Figure 8:
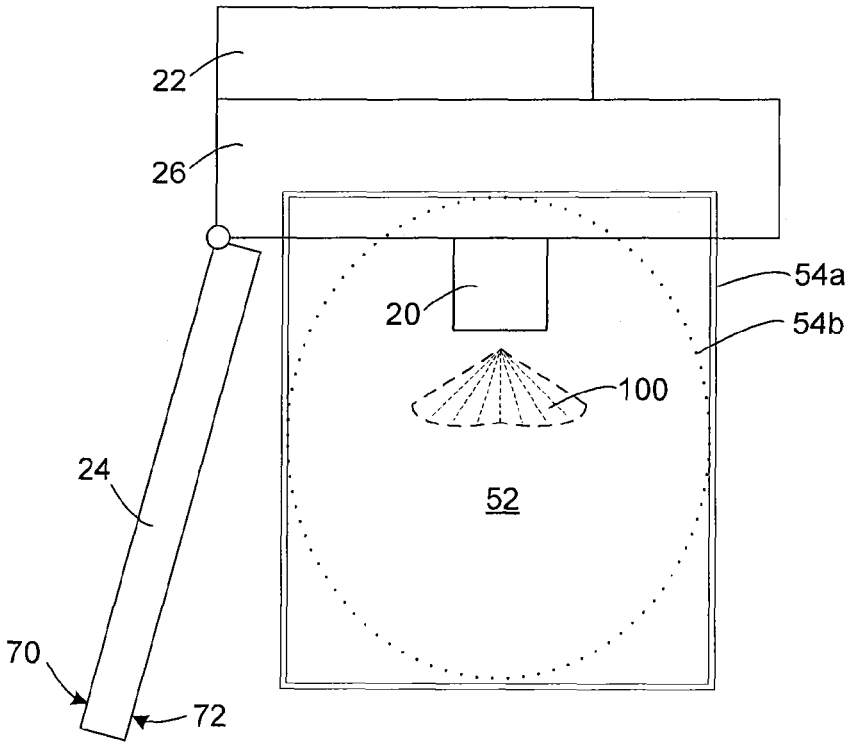
Figure 9:
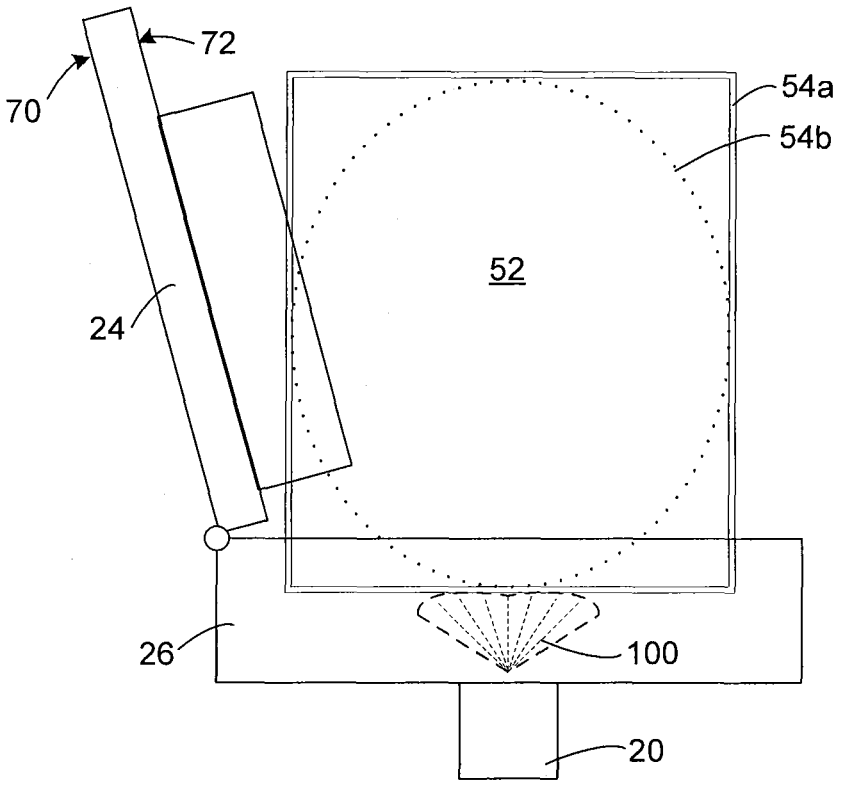
Figure 10:
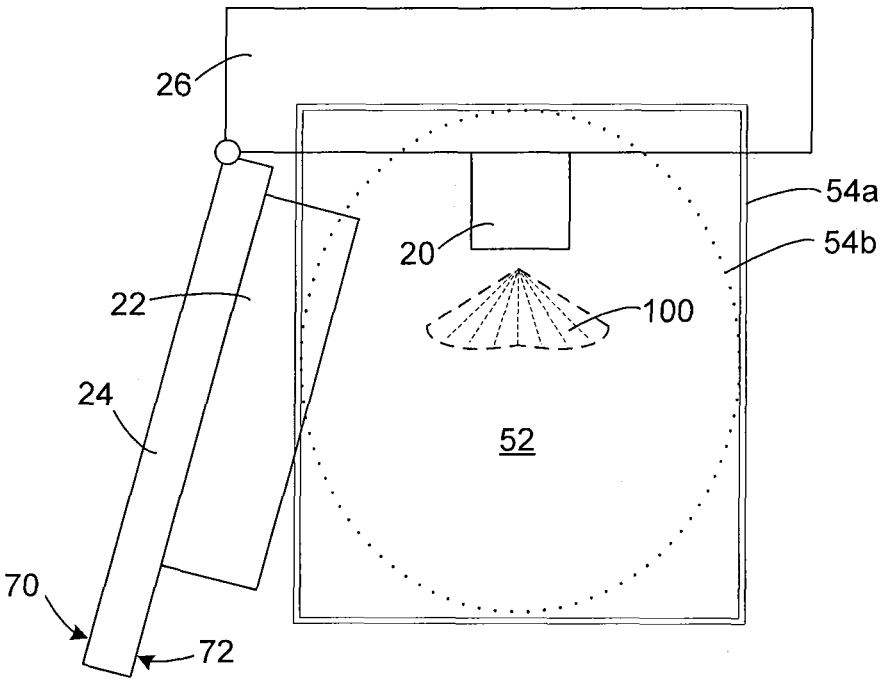

The door motion device 22 in FIGS. 5-10 may be an electromechanical door holder 22*a*, or an automatic door operator 22*b* that is not programmed to open the door in response to a signal from the sensor 84. FIG. 5 shows the door motion device 22 including a door closer 102, and the door control apparatus 20 both mounted to the door frame 26 on the pull side 70 of the door 24. FIG. 6 shows the door motion device 22 and the door control apparatus 20 both mounted to the door frame 26 on the push side 72 of the door 24. FIG. 7 shows the door motion device 22 and door control apparatus 20 mounted on opposite sides of the door frame 26, with the door motion device 22 being on the pull side 70 and the door control apparatus 20 being on the push side 72. FIG. 8 again shows the door motion device 22 and door control apparatus 20 mounted on opposite sides of the door frame 26, but with the door motion device 22 being on the push side 72 and the door control apparatus 20 being on the pull side 70. FIGS. 9 and 10 show the door motion device 22 mounted to the pull side 70 of the door 24, with the door control apparatus 20 being mounted to the door frame 26 on the push side 72 in FIG. 9 and to the pull side 70 in FIG. 10.

Figure 11:
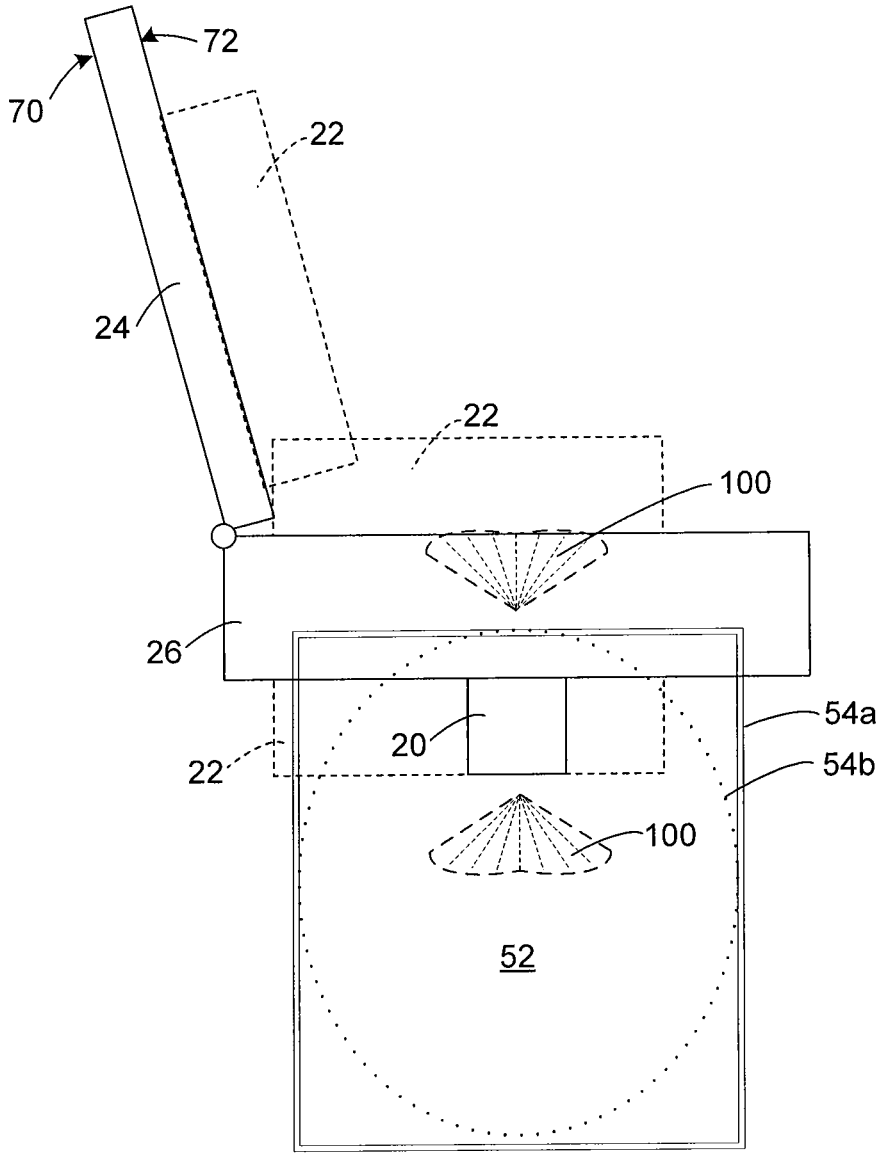

FIG. 11 shows a door motion device 22 that may be of any type, including an automatic door operator 22*b* that is programmed to open the door in response to a signal from the sensor 84, including either a door closer or a motor 104 with a motor-driven closing function. Three alternate locations for mounting the door motion device 22 are shown. The door control apparatus 20 is mounted on the push side of the door 24 and the sensor 84 may be directed to avoid detecting the motion of the door 24. Where an automatic door operator is programmed to move the door 24 to the fully open position when detecting a person, the closing motion of the door 24 would result in the door 24 being detected, and the door 24 would be opened again when the sensor 84 detects the door 24 closing. Therefore, the sensor 84 may be oriented to detect motion on the push side 72 of the door 24, through which the door 24 does not pass.

Figure 12A:
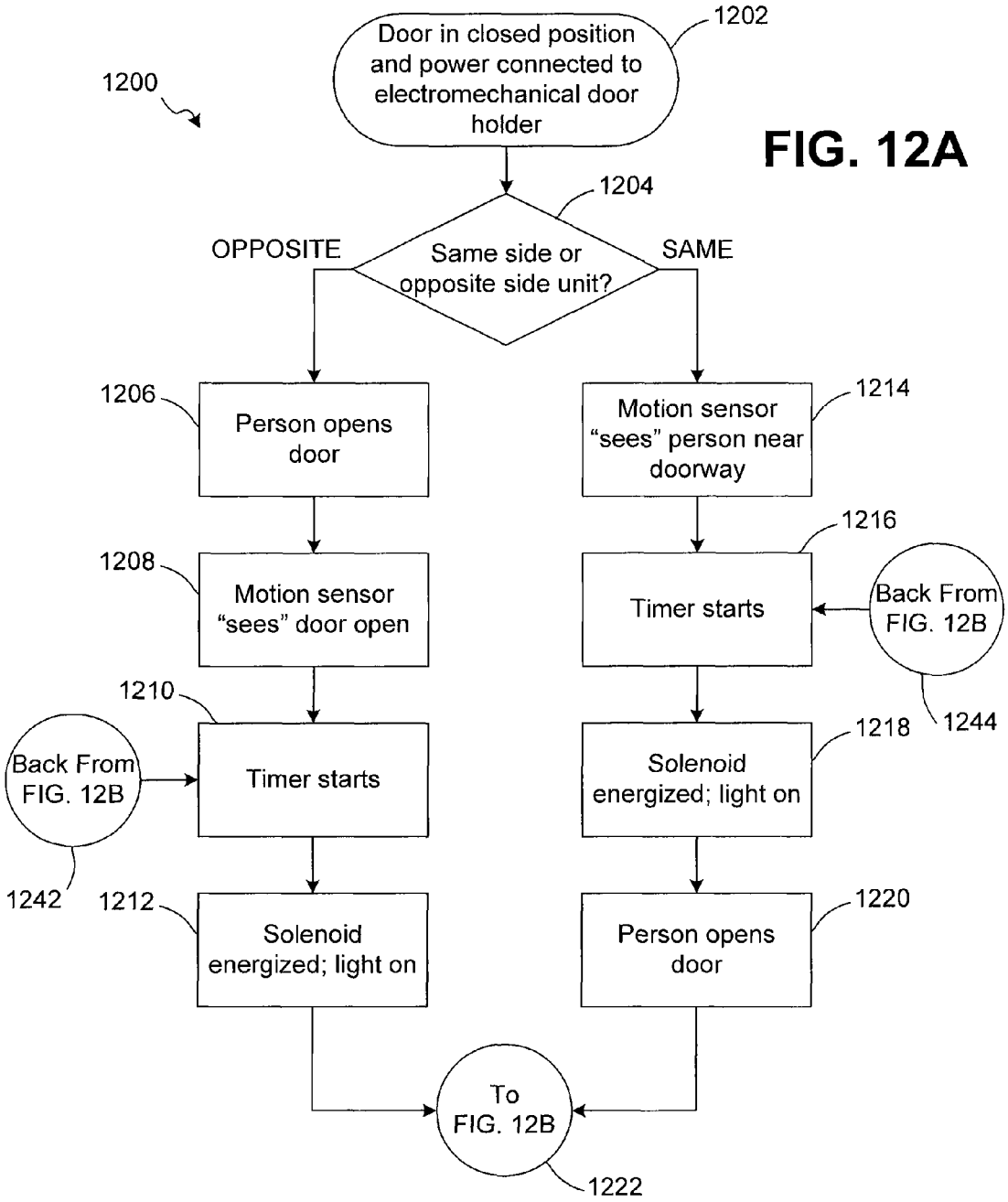

FIGS. 12A-14D show embodiments of the operation of various door control apparatus 20. When a light emitter 60 (and/or sound emitter), solenoid 30, or motor 100 act, they are acting in response to a signal, or the lack of a signal, from the control circuitry 83, which receives signals from the sensor 84. FIGS. 12A and 12B show an embodiment 1200 of the operation of the door control apparatus when used with an electromechanical door holder. Operation begins with the door in the closed position and power connected to the electromechanical door holder 1202. At decision step 1204, the operation is then based on whether the unit, or door control apparatus 20, is mounted on the same side of the door as the person opening the door (a "same side" unit), or on the opposite side of the door from the person opening the door (an "opposite side" unit).

If the door control apparatus 20 is an opposite side unit, the person first opens the door 1206 and the motion sensor detects the opening of the door 1208 and signals the control circuitry. A timer then starts 1210, and a solenoid in the door holder is energized 1212 in response to a signal from the control circuitry to close a valve in the door holder that will prevent flow of hydraulic fluid in the reservoir at a selected port and cause the door to stay open. Optionally and concurrently, when the timer starts, the light emitter is also turned on 1212 in response to a signal from the control circuitry so that the light illuminates the designated floor area; a sound emitter could also alarm when the door is opening.

If the door control apparatus 20 is a same side unit, the motion sensor detects the person near the doorway 1214. A timer then starts 1216, and a solenoid in the door holder is energized 1218 in response to a signal from the sensor via the control circuitry to close a valve in the door holder that will prevent flow of hydraulic fluid in the reservoir at a selected port and cause the door to stay open. When the timer starts, optionally and concurrently the light emitter is also turned on in response to a signal from the sensor via the control circuitry so that the light illuminates the designated floor area 1218. Then the person opens the door 1220.

With the timer started, solenoid energized, floor area illuminated, and door open for either the same side unit or opposite side unit, the operation proceeds through transfer circle 1222 to FIG. 12B. The door stays open at whatever position the person releases the door 1224 for a predetermined set period. If the person is still near the doorway at decision step 1226, the sensor senses the person, and the solenoid continues to be energized and the light stays on 1228, and the process returns to step 1224. If at decision step 1226 the person is not still near the doorway, the motion sensor detects no one near the doorway 1230 and the light flashes for a set period 1232. If there is a sound emitter, the sound emitter may begin to alarm and continue until the door is closed.

If at decision step 1234 another person is not near the doorway, the sensor senses the person, the sensor stops sending a signal to the control circuitry, the solenoid de-energizes to open the valve, and the light is turned off 1236. If another person is near the doorway 1234 and at decision step 1238 the programmed maximum open time has not been reached, the operation returns to the steps where the timer starts 1210, 1218 through decision step 1240 and transfer circles 1242, 1244, as applicable. If the maximum open time has been reached 1238, the light is turned off and then the solenoid de-energizes 1236 to open the valve. From step 1246 the door begins to close, and then has returned to the closed position 1248.

FIGS. 13A-13D show an embodiment 1300 of the operation of the door control apparatus when used with an automatic door operator. Operation begins with the door in the closed position and power connected to the door operator 1302, and continues at decision step 1304 depending on whether the door operator opens the door or a person opens the door. If the door operator opens the door, a person actuates a switch 1306, which may be, for example, a button, a touch pad, a sensor of various types, or other means known to one of ordinary skill in the art. The door operator then opens the door 1308 to the predetermined fully open position. The motion sensor detects a person near the doorway 1310, and a timer starts 1312. Then a solenoid is energized in response to a signal from the sensor via the control circuitry, and optionally a light illuminates the designated floor area 1314 in response to a similar signal; a sound emitter could also alarm on the door opening.

Figure 13A:
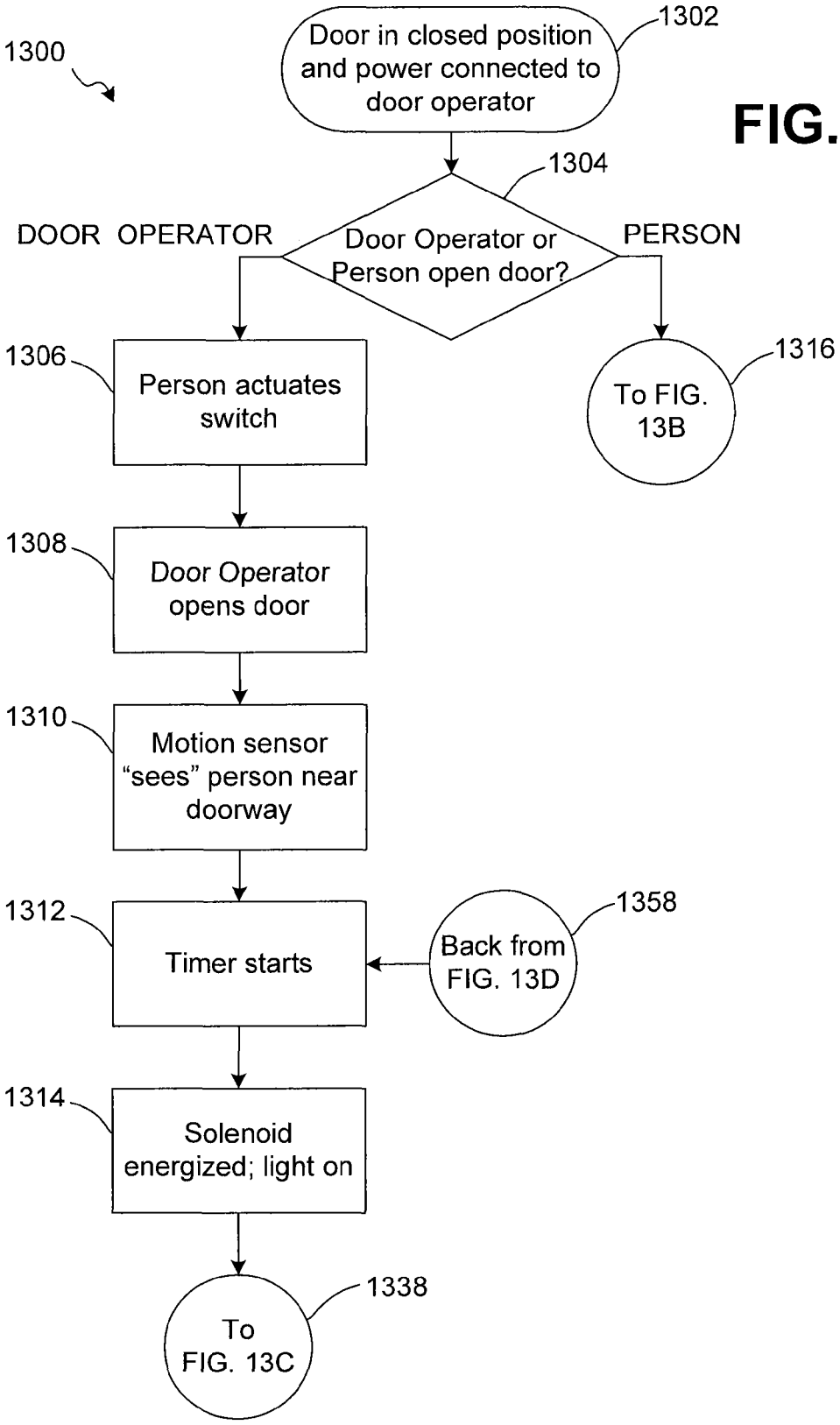
FIGS. 13A-13D are a flow chart of the operation of a door control apparatus embodiment used in conjunction with an automatic door operator including a door closer.
Figure 13B:
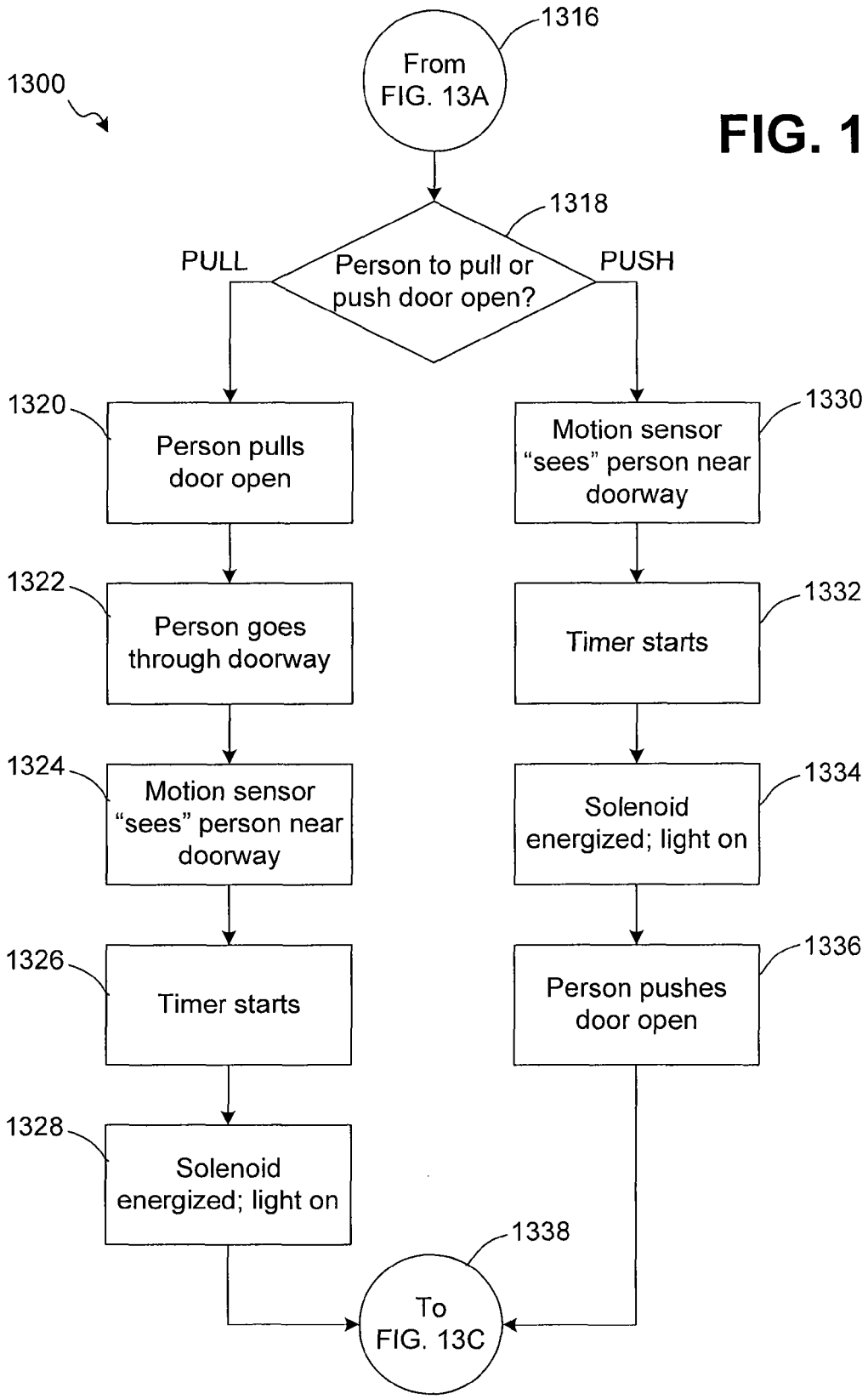

If a person opens the door, the operation proceeds from decision step 1304 through transfer circle 1316 to FIG. 13B. At decision step 1318 the process flow depends on whether the person is to pull or push the door open.

If the person is to pull the door open, the person first opens the door 1320 and then goes through the doorway 1322. The motion sensor detects a person near the doorway 1324. A timer then starts 1326, a solenoid in the door closer is energized in response to a signal from the sensor via the control circuitry, and optionally the light emitter is also turned on similarly so that the light illuminates the designated floor area 1328.

If the person is to push the door open, the motion sensor first detects the person near the doorway 1330. A timer then starts 1332, a solenoid in the door closer is energized in response to a signal from the sensor via the control circuitry, and optionally the light emitter is also turned on so that the light illuminates the designated floor area 1334. A sound emitter could also alarm. Then the person pushes open the door 1336.

Figure 13C:
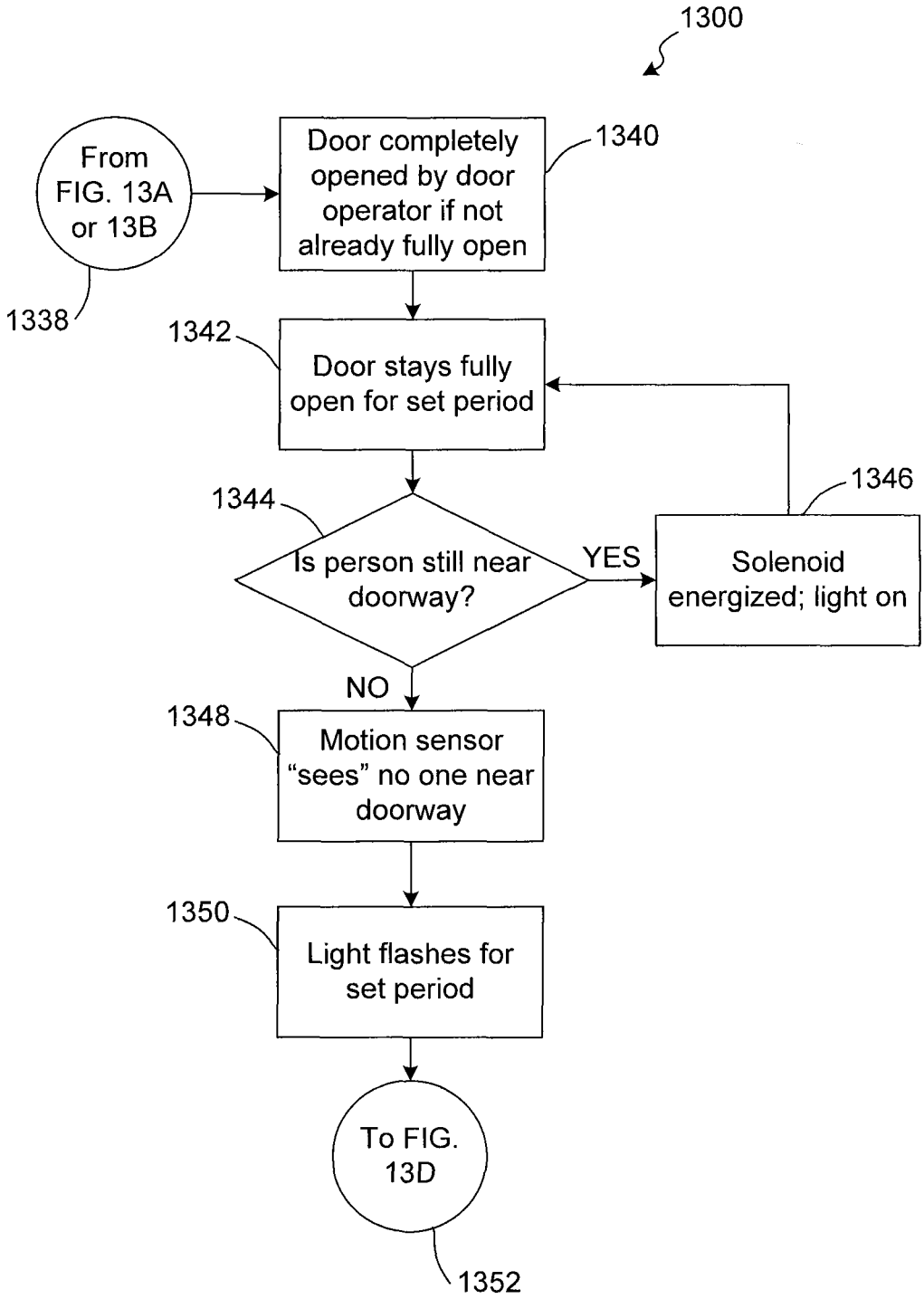

With the timer started, solenoid energized, floor area illuminated, and door open, the process proceeds through transfer circle 1338 to FIG. 13C, as does the operation from step 1314 on FIG. 13A. In step 1340, in the embodiment of a door operator currently being discussed, the door is completely opened by the door operator if it is not already fully open. The door stays open for at least a predetermined set period 1342, and at decision step 1344, if a person is still near the doorway and is sensed, the solenoid remains energized and the light stays on 1346 based on a continued signal from the sensor via the control circuitry, resulting in the door continuing to stay open, and the light on, for at least the set period 1342. Once there is not a person near the doorway 1344, the motion sensor detects no one 1348, and if there is a light, the light will flash for a set period 1350. Alternatively, the door operator could be configured to operate like a door holder when the door is pushed manually.

Figure 13D:
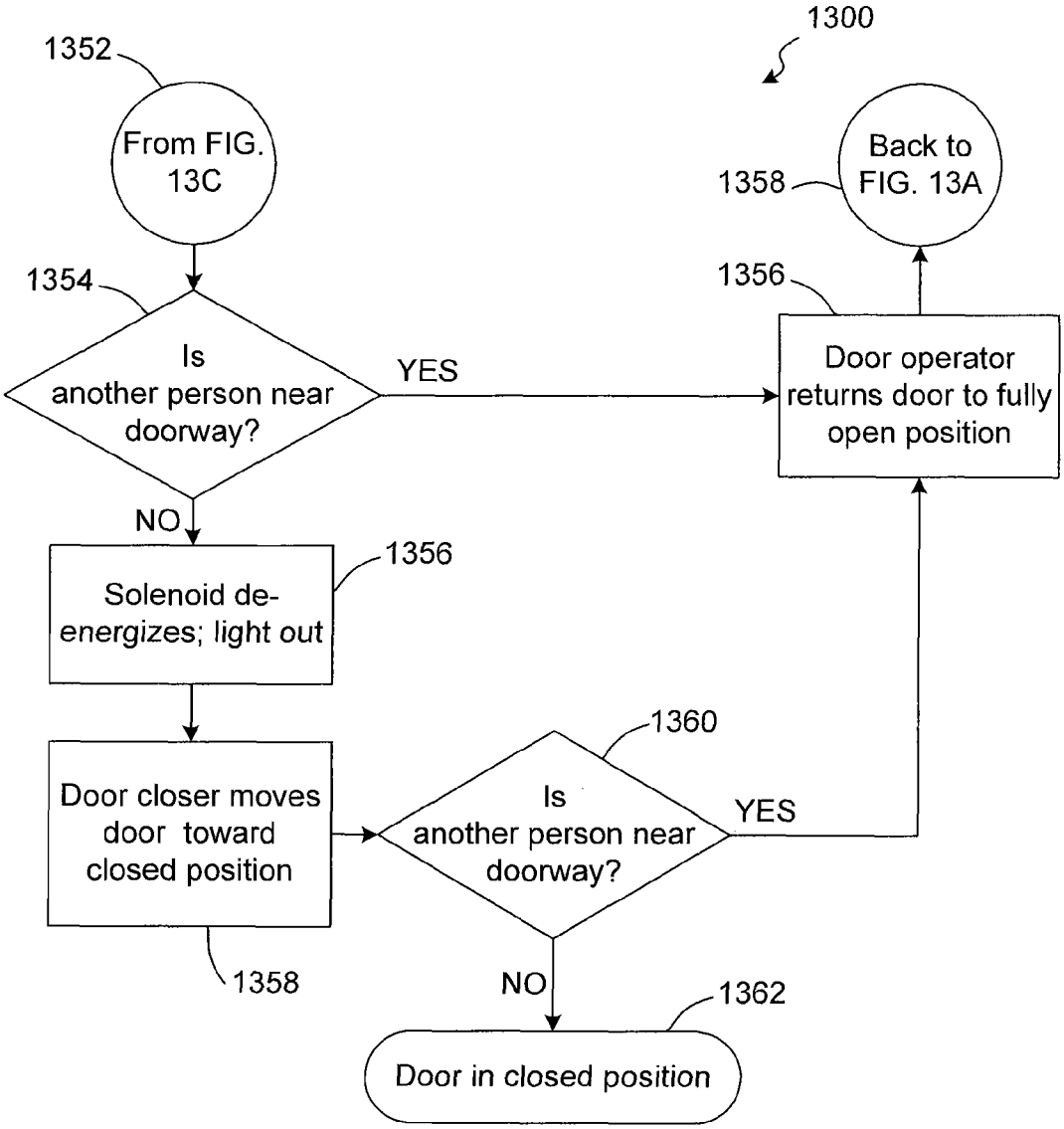

Continuing through transfer circle 1352 to FIG. 13D to decision step 1354, if another person is near the doorway, the door operator engages its motor to return the door to the predetermined fully open position 1356, and the process returns through transfer circle 1358 to restart the timer 1312 on FIG. 13A. If another person is not near the doorway at decision step 1354, the solenoid in the door closer is de-energized in response to the lack of a signal from the sensor via the control circuitry 1356, and the light is likewise turned off. The door operator moves the door towards the closed position 1358. Another decision step 1360 considers whether another person is near the doorway while the door is in the process of closing. If another person is near the doorway, the door operator returns the door to the fully open position 1356, and the operation returns through transfer circle 1358 to step 1312 on FIG. 13A. If no other person has entered the opening, the door continues closing and is returned to the closed position 1362.

FIGS. 14A-14D show another embodiment 1400 of the operation of the door control apparatus when used with an automatic door operator. Operation begins with the door in the closed position and power connected to the door operator 1402, and continues at decision step 1404 depending on whether the door operator opens the door or a person opens the door. If the door operator opens the door, a person actuates a switch 1406, which may be, as discussed above, a button, a touch pad, a sensor of various types, or other means known to one of ordinary skill in the art. The door operator then opens the door 1408 to a predetermined fully open position. The motion sensor detects a person near the doorway 1410, and a timer starts 1412. Then, optionally, in response to a signal from the sensor via the control circuitry, a light illuminates the designated floor area 1414.

Figure 14A:
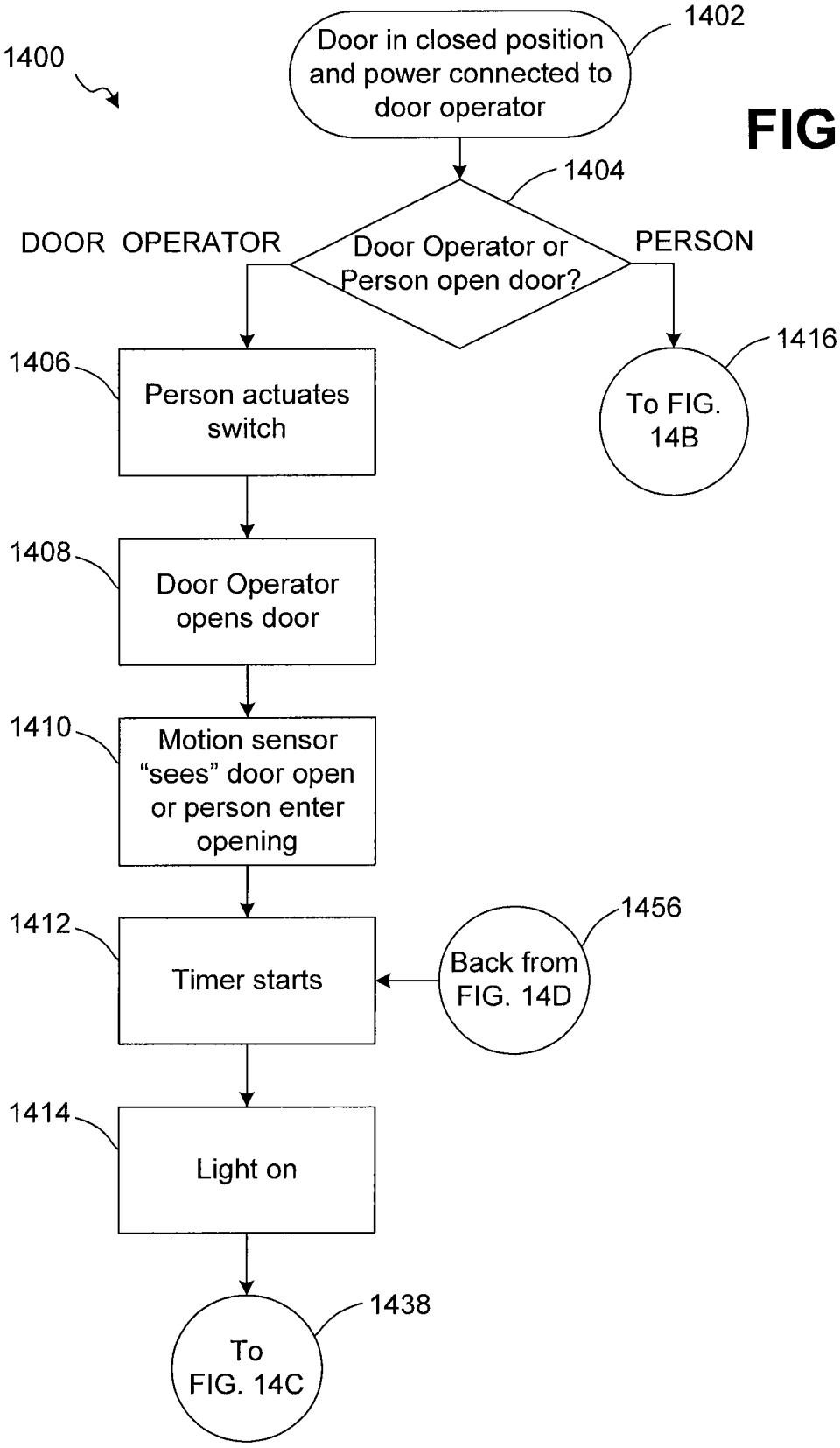
FIGS. 14A-14D is a flow chart of the operation of a door control apparatus embodiment used in conjunction with an automatic door operator with motor-driven open and close functions.
Figure 14B:
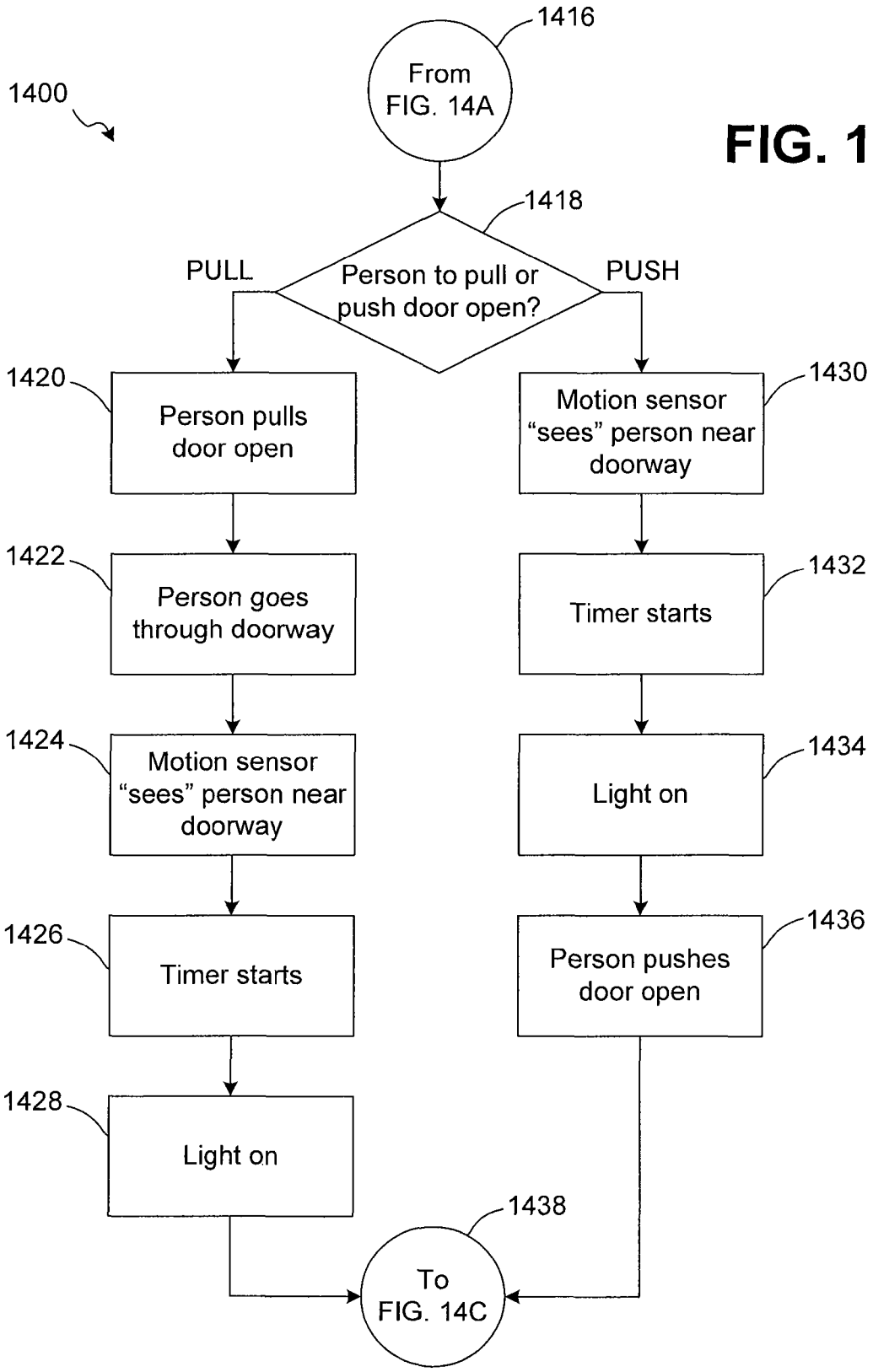

If a person opens the door, the operation proceeds from decision step 1404 through transfer circle 1416 to FIG. 14B. The operation is then based on the decision step 1418 as to whether the person is to pull or push the door open.

If the person is to pull the door open, the person first opens the door 1420 and then goes through the doorway 1422. The motion sensor detects a person near the doorway 1424. A timer then starts 1426, and optionally the light emitter is also turned on so that the light illuminates the designated floor area 1428.

If the person is to push the door open, the motion sensor first detects the person near the doorway 1430. A timer then starts 1432, and optionally the light emitter is also turned on so that the light illuminates the designated floor area 1434. Then the person pushes open the door 1436.

Figure 14C:
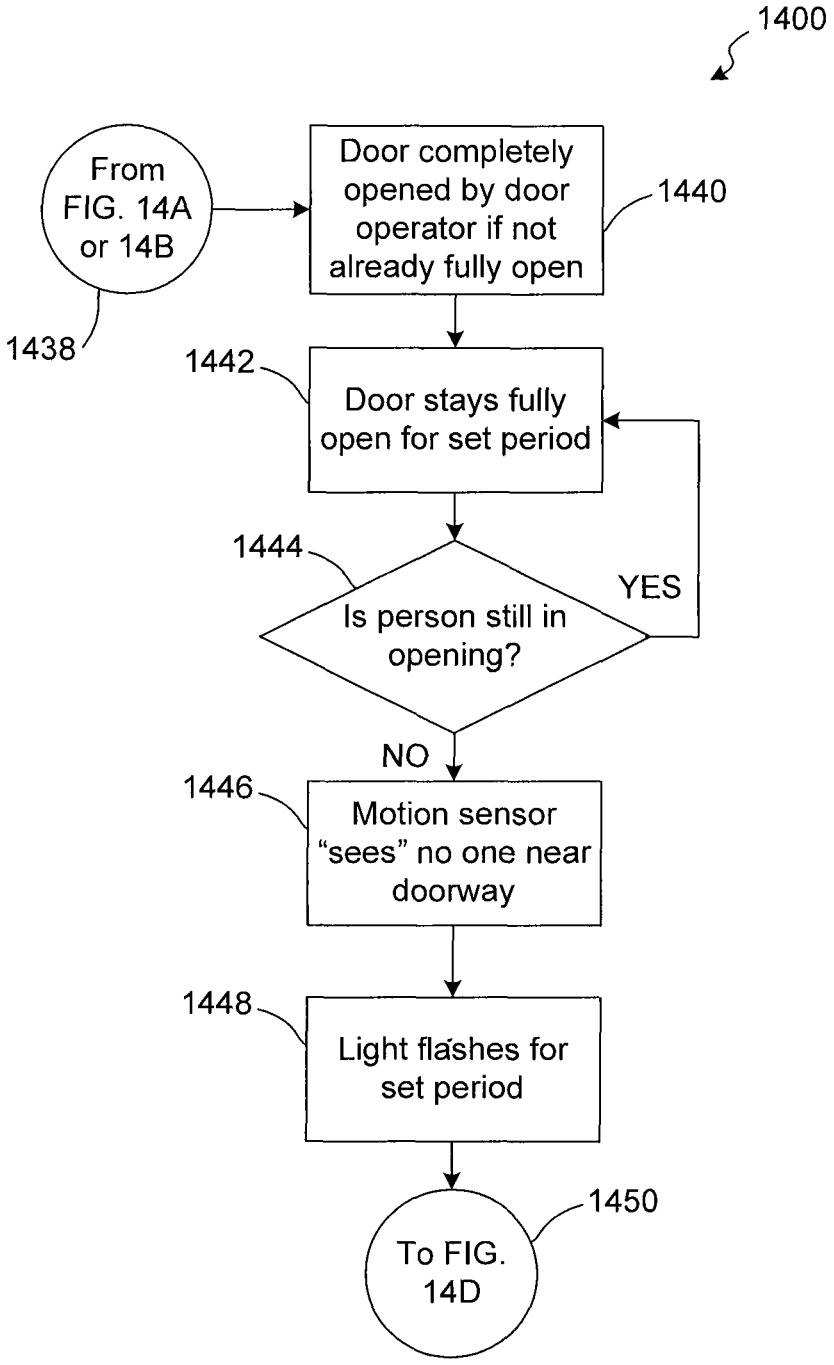

With the timer started, floor area illuminated, and door open, the process proceeds through transfer circle 1438 to FIG. 14C, as does the operation from step 1414 on FIG. 14A. In step 1440, the door is completely opened by the door operator if it is not already in the predetermined fully open position. The door stays open for at least a predetermined set period 1442, and at decision step 1444, if a person is still in the opening, the door continues to stay open for at least the set period 1442. If there is not a person near the doorway, the motion sensor detects no one near the doorway 1446, and if there is a light, the light will flash for a set period 1448. Again, alternatively, the door operator could be configured to operate like a door holder when the door is pushed manually.

Figure 14D:
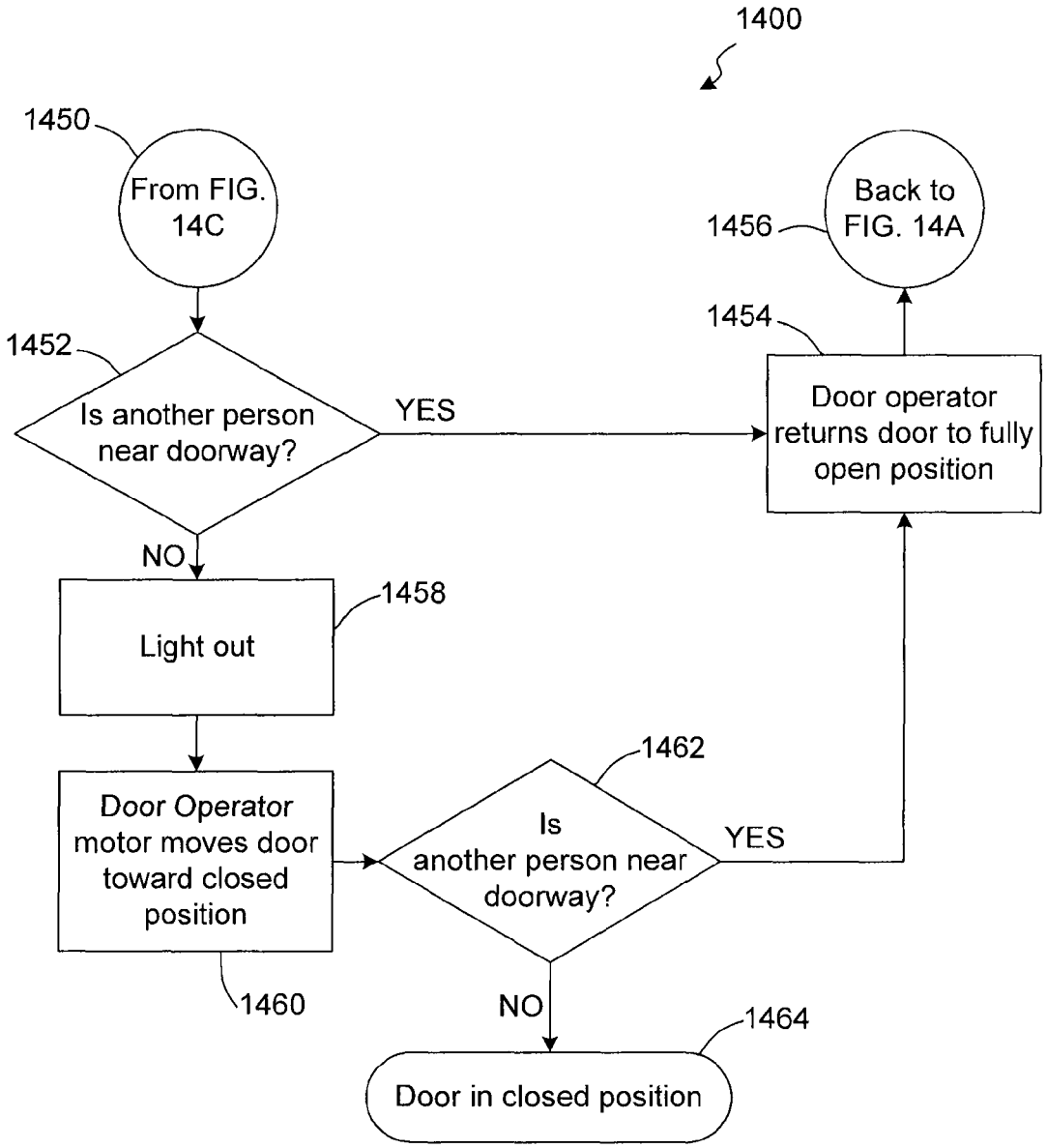

Continuing through transfer circle 1450 to FIG. 14D to decision step 1452, if another person is near the doorway, the door operator engages its motor to return the door to the predetermined fully open position 1454, and the process returns through transfer circle 1456 to restart the timer 1412 on FIG. 14A. If another person is not near the doorway at decision step 1452, the light is turned off 1458 in response to the lack of a signal from the sensor via the control circuitry. The door operator engages its motor to move the door toward the closed position 1460. Another decision step 1462 considers whether another person is near the doorway while the door is in the process of closing. If another person is near the doorway, the door operator engages its motor to return the door to the fully open position 1454, and the operation returns through transfer circle 1456 to step 1412 on FIG. 14A. If no other person has entered the opening, the door continues closing and is returned to the closed position 1464.

Although the door control apparatus described above has been shown and described in considerable detail with respect to only a few exemplary embodiments thereof, it should be understood by those skilled in the art that it is not intended to be limited to these embodiments since various modifications, omissions and additions may be made to the disclosed embodiments without materially departing from the novel teachings and advantages. For example, some of the novel features could be used with any type of door motion device or any type of light emitter. A light emitter may be used other than one that shines a light or a floor, or additional light emitters may be used, including but not limited to the selectively lighted display 66. Accordingly, it is intended to cover all such modifications, omission, additions and equivalents as may be included within the scope of a door control apparatus and associated methods as defined by the following claims. In the claims, where a claim is directed to a method, unless otherwise indicated the order of actions to be performed is not limited to the order in which the actions are written. Further, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A door control apparatus in electrical communication with an electromechanical door holder for operative connection to a hinged door, the electromechanical door holder including a door closer for applying a closing action to the hinged door and a solenoid disposed in the door closer operable to close a valve to prevent the flow of hydraulic fluid in the door closer to cause the hinged door to stay open, the hinged door being above a floor and pivotally movable over a range of open positions between a closed position and a fully open position and being releasable by a person manually opening the door at a release position anywhere in the range of open positions, and the door being mounted to a structure surrounding the door in the closed position, the structure including a door frame and a wall, the door control apparatus comprising:

control circuitry; and a sensor adapted to detect a person, object, or both in a first designated area proximate to the door, the sensor connected to the control circuitry, wherein the sensor is operable to signal the control circuitry upon a detection event, wherein upon a detection event the control circuitry is operable to signal the solenoid to close the valve and cause the electromechanical door holder to hold the door open at a release position that is variable and is not preset, such that the release position may automatically, without manually actuating a switch, be located at any position within the range of open positions of the door.

2. The door control apparatus of claim 1, further comprising a light emitter connected to the control circuitry, wherein upon a detection event the control circuitry is operable to signal the light emitter to produce light.

3. The door control apparatus of claim 2, wherein the light emitter is adapted to direct light to form an image on the floor in a second designated area, wherein when the second designated area is illuminated, the door is not in the process of closing.

4. The door control apparatus of claim 3, wherein the control circuitry is operable to signal the light emitter to change the light status a first predetermined time after the sensor detects nothing in the first designated area and is adapted to signal the electromechanical door holder to initiate door closing after a second predetermined time, with the first and second predetermined times being measured by a timer in the control circuitry.

5. The door control apparatus of claim 4, wherein the light status includes on, off, or flashing.

6. The door control apparatus of claim 2, wherein the light emitter includes a laser generator and the light is laser light.

7. The door control apparatus of claim 6, wherein the laser light image to be formed on the floor includes words, other indicia, or a combination thereof.

8. The door control apparatus of claim 2, wherein the light emitter includes a light emitting diode lamp.

9. The door control apparatus of claim 2, further comprising a housing in which the control circuitry, light emitter, and sensor are disposed, wherein the housing is adapted to be mounted to the structure adjacent to the door.

10. The door control apparatus of claim 9, further comprising a mounting member disposed in the housing, wherein the control circuitry, light emitter, and sensor are mounted to the mounting member.

11. The door control apparatus of claim 10, wherein the mounting member comprises a printed circuit board.

12. The door control apparatus of claim 10, wherein the mounting member is mounted to the housing with adjustable fastener components at a plurality of locations that allow varying the angle of the mounting member relative to the housing.

13. The door control apparatus of claim 12, wherein the mounting member is substantially a rectangle and the plurality of locations comprises four locations with each location substantially in a corner of the substantially rectangular mounting member.

14. The door control apparatus of claim 1, further comprising a sound emitter connected to the control circuitry, wherein the control circuitry is selectively operable to signal the sound emitter to produce sound.

15. The door apparatus of claim 1, further comprising a timer and wherein the control circuitry is operable to signal the timer to start upon a detection event and after a predetermined time after the sensor detects nothing to signal the solenoid to open the valve and cause the electromechanical door holder to initiate door closing.

16. The door control apparatus of claim 1, wherein after a predetermined time following a detection event during which there is no further detection event, the control circuitry is operable to signal the solenoid to open the valve and allow the electromechanical door holder to close the door from the variable release position.

17. The door control apparatus of claim 1, wherein the detection event is a first detection event and upon a subsequent second detection event the control circuitry is operable to signal the solenoid to close the valve and cause the electromechanical door holder to hold the door open at a second release position that is variable, is not preset, and may automatically be located at any position within the range of open positions at the release position.

18. A door motion controller for applying force to a hinged door, the hinged door being above a floor and pivotally movable over a range of open positions between a closed position and a fully open position, being released by a person manually opening the door to a release position anywhere in an open position, and being mounted to a structure surrounding the door in the closed position, the structure including a door frame and a wall, comprising:

an electromechanical door holder adapted to operatively connect to the hinged door, the electromechanical door holder including a door closer for applying a closing action to the hinged door and a solenoid disposed in the door closer and operable to close a valve to prevent the flow of hydraulic fluid in the door closer to cause the hinged door to stay open; and a door control apparatus adapted to be in electrical communication with the electromechanical door holder, the door control apparatus comprising:

control circuitry; and a sensor adapted to detect a person, object, or both in a first designated area proximate to the door, the sensor connected to the control circuitry, wherein the sensor is operable to signal the control circuitry upon a detection event, wherein upon a detection event the control circuitry is operable to signal the solenoid to close the valve and cause the electromechanical door holder to hold the door open at a release position that is variable and is not preset, such that the release position may automatically, without manually actuating a switch, be located at any position within the range of open positions of the door.

19. The door motion controller of claim 18, further comprising a light emitter connected to the control circuitry, wherein upon a detection event the control circuitry is operable to signal the light emitter to produce light.

20. The door motion controller of claim 19, wherein the light emitter is adapted to direct light to form an image on the floor in a second designated area wherein when the second designated area is illuminated, the door is not in the process of closing.

21. The door motion controller of claim 20, wherein the control circuitry is operable to signal the light emitter to change the light status a first predetermined time after the sensor detects nothing in the first designated area and operable to signal the electromechanical door holder to initiate door closing after a second predetermined time, with the first and second predetermined times being measured by a timer in the control circuitry.

22. The door motion controller of claim 21, wherein the light status includes on, off, or flashing.

23. The door motion controller of claim 20, wherein the light emitter includes a laser generator and the light is laser light.

24. The door motion controller of claim 23, wherein the laser light image to be formed on the floor includes words, other indicia, or a combination thereof.

25. The door motion controller of claim 20, wherein the light emitter includes a light emitting diode lamp.

26. The door motion controller of claim 20, further comprising a housing in which the control circuitry, light emitter, and sensor are disposed, wherein the housing is adapted to be mounted to the structure adjacent to the door.

27. The door motion controller of claim 26, further comprising a mounting member disposed in the housing, wherein the control circuitry, light emitter, and sensor are mounted to the mounting member.

28. The door motion controller of claim 27, wherein the mounting member comprises a printed circuit board.

29. The door motion controller of claim 27, wherein the mounting member is mounted to the housing with adjustable fastener components at a plurality of locations that allow varying the angle of the mounting member relative to the housing.

30. The door motion controller of claim 29, wherein the mounting member is substantially a rectangle and the plurality of locations comprises four locations with each location substantially in a corner of the substantially rectangular mounting member.

31. The door motion controller of claim 18, further comprising a sound emitter connected to the control circuitry, wherein the control circuitry is selectively operable to signal the sound emitter to produce sound.

32. The door motion controller of claim 18, wherein the door control apparatus further comprises a timer and wherein the control circuitry is operable to signal the timer to start upon a detection event and after a predetermined time after the sensor detects nothing to signal the solenoid to open the valve and cause the electromechanical door holder to initiate door closing.

33. The door motion controller of claim 18, wherein after a predetermined time following a detection event during which there is no further detection event, the control circuitry is operable to signal the solenoid to open the valve and allow the electromechanical door holder to close the door from the variable release position.

34. A method of operating a hinged door using an electromechanical door holder, the electromechanical door holder including a door closer for applying a closing action to the hinged door and a solenoid disposed in the door closer and-operable to close a valve to prevent the flow of hydraulic fluid in the door closer to cause the hinged door to stay open, the hinged door being above a floor and pivotally movable over a range of open positions between a closed position and a fully open position, being released by a person manually opening the door to a release position anywhere in an open position, and being mounted to a structure surrounding the door in the closed position, the structure including a door frame and a wall, the method comprising:

a sensor detecting a person, object, the door moving to an open position, or any combination thereof in a first designated area, the sensor signaling the control circuitry;

a timer in the control circuitry starting;

the control circuitry signaling the solenoid to close the valve and cause the electromechanical door holder to hold the door open; and the electromechanical door holder maintaining the door in an open position at least for a set period at a release position that is variable and is not preset, such that the release position may automatically, without manually actuating a switch, be located at any position within the range of open positions of the door.

35. The method of claim 34, further comprising the control circuitry signaling a light emitter to produce light and the light emitter directing light to form an image on a second designated area on the floor.

36. The method of claim 35, wherein the electromechanical door holder with the door closer includes at least one spring, the control circuitry signaling the electromechanical door holder to hold the door open comprises the control circuitry signaling the electromechanical door holder to energize the solenoid to actuate a valve in the door closer, and the electromechanical door holder holding the door open comprises the electromechanical door holder holding the door open proximate to the position at which the door was released, and further comprising:

energizing the solenoid after the electromechanical door holder receives a signal from the control circuitry;

the sensor continuing to detect a person or object in the first designated area and signaling the control circuitry to keep the solenoid energized;

when the sensor detects nothing in the first designated area, ceasing signaling the control circuitry;

if the sensor again detects a person or object in the first designated area, the sensor signaling the control circuitry, and the control circuitry signaling the electromechanical door holder to keep the solenoid energized; and if the sensor detects nothing in the first designated area by the end of the set period, the control circuitry signaling the electromechanical door holder to initiate closing of the door.

37. The method of claim 34, further comprising:

the sensor continuing to detect a person or object in the first designated area and signaling the control circuitry to keep the door open;

when the sensor detects nothing in the first designated area, ceasing signaling the control circuitry;

if the sensor detects a second person in the first designated area with the door being released by the second person to a second release position anywhere in an open position, the sensor signaling the control circuitry, and the control circuitry signaling the electromechanical door holder to keep the door open at the second release position;

if the sensor detects nothing in the first designated area by the end of the set period, the control circuitry signaling the electromechanical door holder to initiate closing of the door from the second release position.

38. The method of claim 34, further comprising:

the sensor continuing to detect a person or object in the first designated area and signaling the control circuitry to keep the door open;

when the sensor detects nothing in the first designated area, ceasing signaling the control circuitry;

if the sensor again detects a person or object in the first designated area, the sensor signaling the control circuitry, and the control circuitry signaling the electromechanical door holder to keep the door open;

if the sensor detects nothing in the first designated area by the end of the set period, the control circuitry signaling the electromechanical door holder to initiate closing of the door from the variable release position.

39. A door assembly, the assembly being positioned above a floor proximate to a structure including a door frame and wall, comprising:

a hinged door pivotally movable over a range of open positions between a closed position and a fully open position, being released by a person manually opening the door to a release position anywhere in an open position, and being mounted to the structure surrounding the door;

an electromechanical door holder operatively connected to the hinged door; the electromechanical door holder including a door closer for applying a closing action to the hinged door and a solenoid operable to close a valve to prevent the flow of hydraulic fluid in a reservoir to cause the hinged door to stay open, and a door control apparatus in electrical communication with the door motion device comprising:

control circuitry; and a sensor adapted to detect a person, object, or both in a first designated area proximate to the door, the sensor connected to the control circuitry, wherein the sensor signals the control circuitry upon a detection event, wherein upon a detection event the control circuitry signals the solenoid to close the valve and cause the electromechanical door holder to hold the door open at a release position that is variable and is not preset, such that the release position may automatically, without manually actuating a switch, be located at any position within the range of open positions of the door.

40. The door assembly of claim 39, wherein the door control apparatus further comprises a timer and wherein the control circuitry is operable to signal the timer to start upon a detection event and after a predetermined time after the sensor detects nothing to signal the solenoid to open the valve and cause the electromechanical door holder to initiate door closing.

41. The door assembly of claim 39, wherein after a predetermined time following a detection event during which there is no further detection event, the control circuitry is operable to signal the solenoid to open the valve and allow the electromechanical door holder to close the door from the variable release position.

42. A door motion controller for applying force to a hinged door, the hinged door being above a floor and pivotally movable over a range of open positions between a closed position and a fully open position, being released by a person manually opening the door to a release position anywhere in an open position, and being mounted to a structure surrounding the door in the closed position, the structure including a door frame and a wall, comprising:

an electromechanical door holder adapted to operatively connect to the hinged door, the electromechanical door holder comprising:

a door closer for applying a closing action to the hinged door;

hydraulic fluid disposed in the door closer;

a valve disposed in the door closer to control flow of hydraulic fluid;

a solenoid disposed in the door closer and operably connected to the valve and operable to close the valve to prevent the flow of hydraulic fluid in the door closer to cause the hinged door to stay open; and a door control apparatus adapted to be in electrical communication with the electromechanical door holder, the door control apparatus comprising:

control circuitry; and a sensor adapted to detect a person, object, or both in a first designated area proximate to the door, the sensor connected to the control circuitry, wherein the sensor is operable to signal the control circuitry upon a detection event, wherein upon a detection event the control circuitry is operable to signal solenoid to close the valve and cause the electromechanical door holder to hold the door open at a release position that is variable and is not preset, such that the release position may automatically, without manually actuating a switch, be located at any position within the range of open positions of the door.

* * * * *